US007726485B2

(12) United States Patent
Brollier

(10) Patent No.: US 7,726,485 B2
(45) Date of Patent: Jun. 1, 2010

(54) MOMENTARY SWITCH INTEGRATED IN PACKAGING OF AN ARTICLE

(75) Inventor: Brian W. Brollier, Cincinnati, OH (US)

(73) Assignee: International Paper Company, Memphis, TN (US)

( * ) Notice: Subject to any disclaimer, the term of this patent is extended or adjusted under 35 U.S.C. 154(b) by 712 days.

(21) Appl. No.: 11/637,385

(22) Filed: Dec. 12, 2006

(65) Prior Publication Data

US 2007/0246396 A1 Oct. 25, 2007

Related U.S. Application Data

(60) Provisional application No. 60/749,559, filed on Dec. 12, 2005.

(51) Int. Cl.
*B65D 83/04* (2006.01)

(52) U.S. Cl. ..... 206/534; 206/532; 206/538; 206/539; 368/10; 340/309.7

(58) Field of Classification Search ..... 206/467, 206/468, 469, 531, 532, 534.1, 538, 539, 206/534, 459.1; 116/307; 368/10, 11, 107, 368/109; 222/25; 340/572.1, 572.9, 309.3, 340/309.7

See application file for complete search history.

(56) References Cited

U.S. PATENT DOCUMENTS

| | | | | |
|---|---|---|---|---|
| 4,286,399 | A | 9/1981 | Funahashi et al. | |
| 4,363,081 | A | 12/1982 | Wilbur | |
| 4,526,474 | A | 7/1985 | Simon | |
| 4,616,316 | A | 10/1986 | Hanpeter et al. | |
| 4,617,557 | A * | 10/1986 | Gordon | 340/309.7 |
| 4,660,991 | A * | 4/1987 | Simon | 368/10 |
| 4,988,004 | A | 1/1991 | Intini | |
| 5,142,372 | A | 8/1992 | Alfano et al. | |
| 5,181,189 | A | 1/1993 | Hafner | |
| 5,313,439 | A | 5/1994 | Albeck | |

(Continued)

FOREIGN PATENT DOCUMENTS

| | | |
|---|---|---|
| EP | 1214924 | 6/2002 |

(Continued)

*Primary Examiner*—David T Fidei
(74) *Attorney, Agent, or Firm*—Matthew M. Eslami

(57) ABSTRACT

The present invention relates to a switch for use with an article formed from paperboard. The article includes a first panel and a second panel. The first panel and the second panel each have a sliding surface facing one another. The first and the second panels are in sliding relation to one another between a first position and a second position. The switch comprises a conductive pathway disposed on the sliding surface of the first panel and a first contact surface is disposed on the sliding surface of the second panel and a second contact surface is disposed on the sliding surface of the second panel. The second contact surface is in spaced relation to the first contact surface so as to prevent electrical communication between the first and second contact surfaces. The conductive pathway of the first panel is in spaced relation to at least one of the first and second contact surfaces of the second panel when the first and second panels are in the first position. The conductive pathway bridges the first and second contact surfaces when the first and second panels are in the second position to thereby permitting electrical communication between said first and second contact surfaces.

38 Claims, 28 Drawing Sheets

U.S. PATENT DOCUMENTS

| | | | | |
|---|---|---|---|---|
| 5,412,372 | A * | 5/1995 | Parkhurst et al. | 340/568.1 |
| 5,836,474 | A | 11/1998 | Wessberg | |
| 5,871,831 | A | 2/1999 | Zeiter et al. | |
| 6,244,462 | B1 * | 6/2001 | Ehrensvard et al. | 221/7 |
| 6,335,907 | B1 | 1/2002 | Momich et al. | |
| 6,411,567 | B1 | 6/2002 | Niemiec et al. | |
| 6,574,166 | B2 | 6/2003 | Niemiec | |
| 6,625,518 | B2 | 9/2003 | Depeursinge | |
| 6,628,199 | B1 | 9/2003 | Ehrensvard et al. | |
| 6,681,935 | B1 | 1/2004 | Lewis | |
| 7,093,716 | B2 | 8/2006 | Intini | |
| 7,113,101 | B2 | 9/2006 | Petersen et al. | |
| 7,119,684 | B2 | 10/2006 | Petersen et al. | |
| 7,126,879 | B2 * | 10/2006 | Snyder | 368/10 |
| 7,178,417 | B2 | 2/2007 | Petersen et al | |
| 7,198,173 | B2 * | 4/2007 | Simon | 221/25 |
| 7,489,594 | B2 * | 2/2009 | Simon et al. | 368/10 |
| 7,552,824 | B2 * | 6/2009 | Le et al. | 206/534 |
| 2003/0074421 | A1 | 4/2003 | Kusano et al. | |
| 2003/0111477 | A1 | 6/2003 | Niemiec et al. | |
| 2004/0050746 | A1 | 3/2004 | Dunlop et al. | |
| 2004/0178112 | A1 | 9/2004 | Snyder | |

FOREIGN PATENT DOCUMENTS

| | | |
|---|---|---|
| WO | WO 89/09042 | 10/1989 |
| WO | WO 95/14456 | 6/1995 |
| WO | WO 02/083056 | 10/2002 |

* cited by examiner

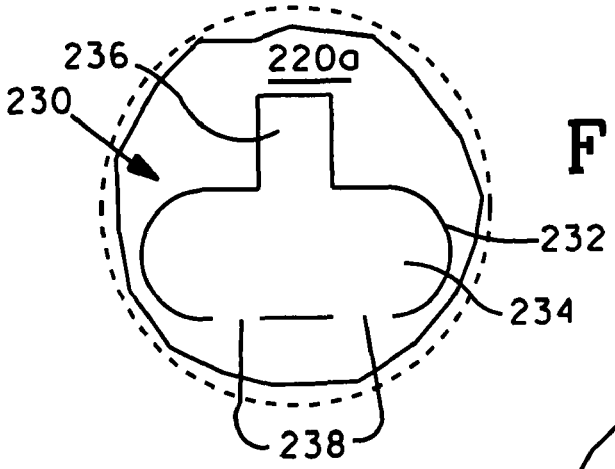
Fig. 3B
Fig. 3C
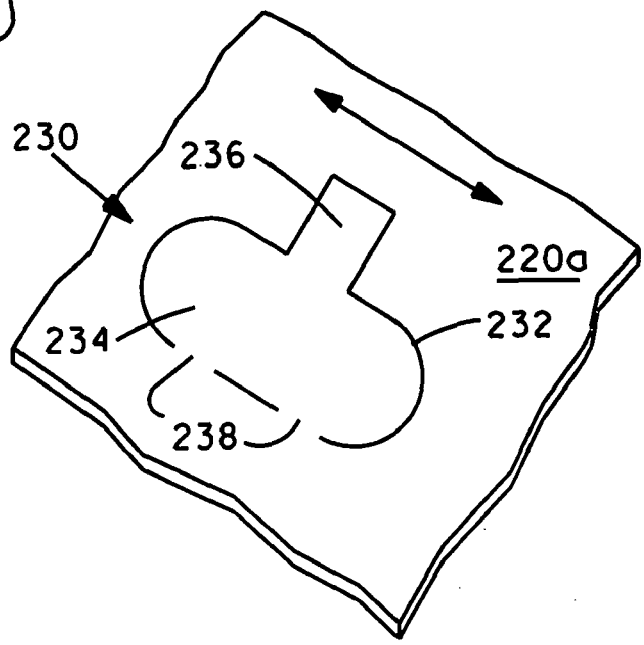
Fig. 3D
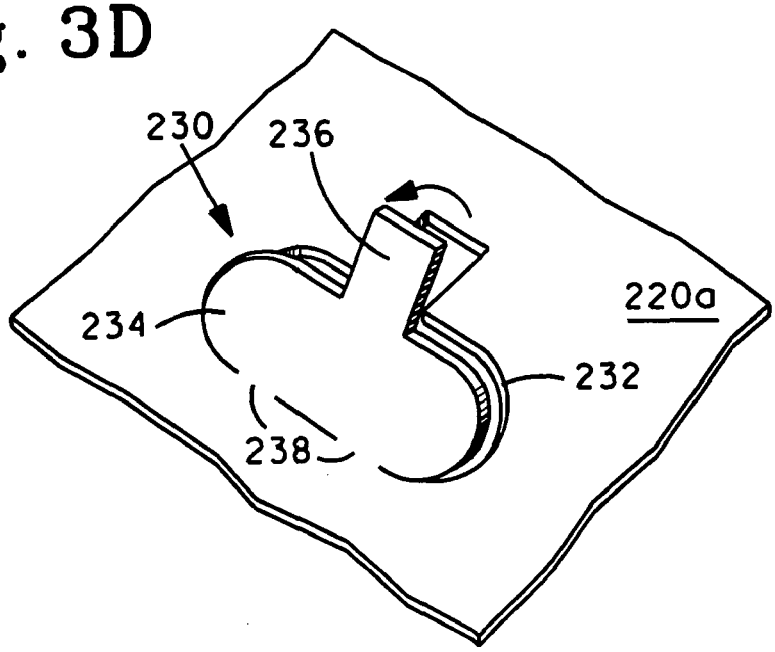

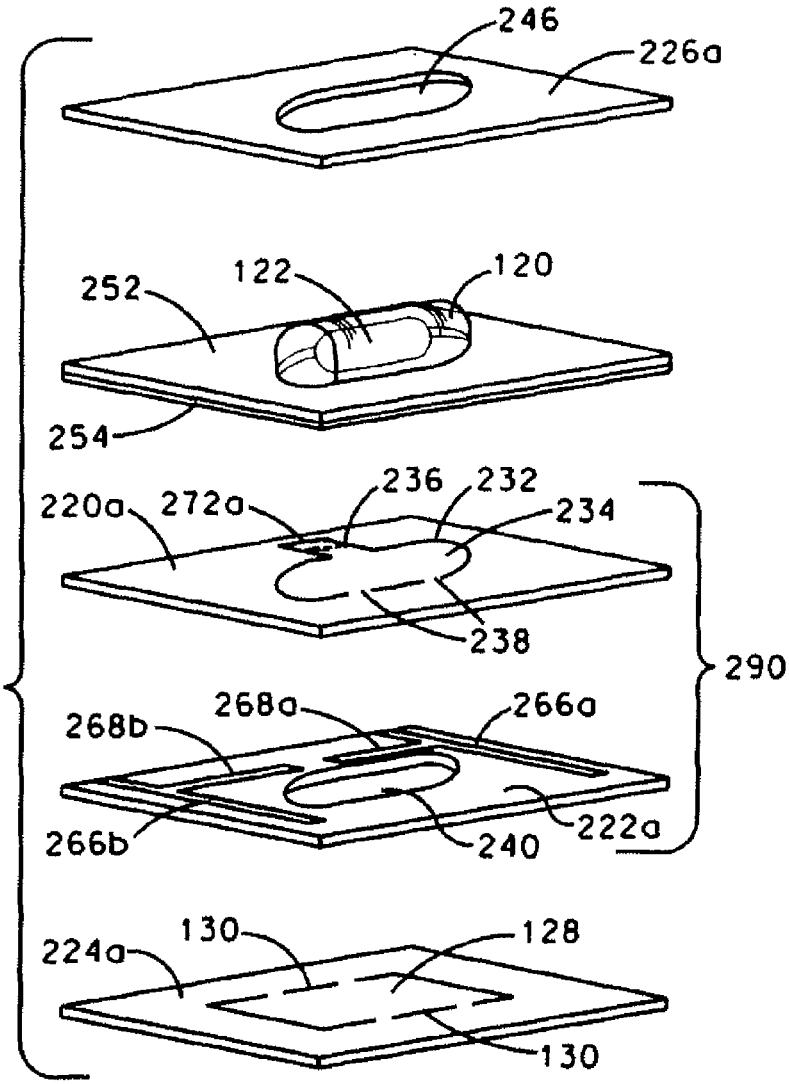
Fig. 9A
Fig. 9B
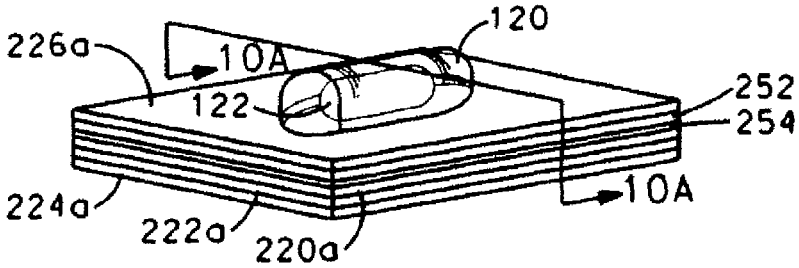

MOMENTARY SWITCH INTEGRATED IN PACKAGING OF AN ARTICLE

FIELD OF THE INVENTION

The present invention relates generally to a package assembly for storing articles and more particularly, to a package assembly suitable for dispensing pharmaceutical articles such as capsules, tablets, and/or pills wherein the package includes a momentary switch for controlled indication of dispensing of the pills from the package assembly.

BACKGROUND OF THE INVENTION

Packages for drug doses in the form of capsules, tablets, and/or pills are available in a large variety of different sizes, with different numbers of pills contained therein, and with different spatial arrangements. These packages such as medicine storage packages usually include a blister package in which tablets, capsules, or pills are individually sealed between plastic molded pockets for pills and a rupturable foil glued or fused to the first foil. One example of such medicine storage package is disclosed in U.S. Pat. Nos. 4,988,004 and 7,093,716. Often, a memory unit is included in the medicine storage package to produce an acoustic and/or visual alarm signal when it is time to take the next pill.

A common method of detecting a pill being dispensed from a blister package is by breaking an electrical trace which is located in the pathway of the pill as it is pushed out of its blister cavity. For example, a gate is created behind the pill by perforating the paperboard in a pattern like the blister cavity and the conductive trace is run across the gate, passing through some uncut areas in the perforations. There are several problems with this design that either causes a false signal when no pill is dispensed or make it very difficult to push the pill out. The problem with this design is that the uncut areas tend to crack during handling of the blister package over time. This causes a break in the conductive trace and thus a break in the circuit, which in turn, is registered as a pill being falsely dispensed when actually the pill has not been dispensed. Therefore, it is desirable to provide a medicine blister package in which the pill can be easily dispensed from the blister cavity and the package does not cause false signal when no pill is dispensed.

Another problem with the so called break-the-trace design is that the medicine storage package can limit the type of circuitry used to monitor the pills used. With one such configuration, if a user wishes to keep track of which pill is dispensed, the user needs to either use individual resistance levels to each pill (which is very difficult and ineffective for more than a few pills) or the user must have one conductive trace per each pill plus one common trace. This design requires many connections that must be made to the monitoring circuitry thereby overcomplicating the circuitry suitable for a low-cost and easily manufacturable package design. It is therefore desirable to provide a monitoring circuitry switch for packaging of an article, e.g., medicaments that solve the problems, among others, of accidental breakage of the electrical trace which is located in the pathway of the pill and the difficulty in removing the pill from the blister package.

SUMMARY OF THE INVENTION

The present invention relates to a package assembly having an integrated momentary switch therein that is particularly useful in healthcare pharmaceutical packaging. In the preferred embodiment, the momentary switch circuit is defined by a swing door having a conductive contacting surface and two other conductive contact surfaces spaced apart from one another. The two contact surfaces can be printed on a periphery of a punch out. Alternatively, the two contact surfaces can be printed on a first swing door. When the electrical contacting surface is engaged with the other two electrical contact surfaces, the momentary switch circuit is completed. The package assembly is portable, easy to use, inexpensive, and effectively assists a patient in following a prescribed regimen for taking medication. The package assembly comprises a blank, a blister pack, and a momentary switch circuit. The blank is constructed from any suitable foldable material, such as paperboard, that is capable of being die-cut to form a generally rectangular configuration when the blank is in an unfolded position. The blank is divided into a plurality of panels by fold lines or score lines. The plurality of panels are folded along various fold lines in a continuous folding manner to enclose the pills. Two of the plurality of panels having conductive contacting and contact surfaces construct an integrated momentary switch. The blister pack includes a sheet of plastic layer formed into an 2D matrix of blister cavities which each cavity receives the patient's pills. A foil layer seals the open cavities of the blister sheet. The momentary switch permits the accessing of the patient's tablets or capsules in each cavity to be monitored.

Several variations of the assembly package having the momentary switch are provided, wherein the configuration and shapes of the swing doors are modified so as to provide additional functionality for the package assembly, while remaining within the spirit and scope of the present invention. For example, the momentary switch may be integrated into the blister pack so as to reduce the number of panels used in the assembly package. Furthermore, the momentary switch can also be integrated into a container such as, for example corrugated box. Moreover, the package assembly may be equipped to communicate with a physician, pharmacist and/or caregiver to keep them abreast of a compliance of a patient to a prescribed regimen. Finally, the package assembly may include a Radio Frequency IDentification (RFID) tag for identification and/or RF transmitter so as to enable the package assembly to communicate with cell phones and Personal Data Acquisition devices such as palm pilot, blackberry, and the like.

One aspect of the present invention relates to a switch for use with an article formed from paperboard. The article includes a first panel and a second panel. The first panel and the second panel each have a sliding surface facing one another. The first and the second panels are in sliding relation to one another between a first position and a second position. The switch comprises a conductive pathway disposed on the sliding surface of the first panel and a first contact surface is disposed on the sliding surface of the second panel and a second contact surface is disposed on the sliding surface of the second panel. The second contact surface is in spaced relation to the first contact surface so as to prevent electrical communication between the first and second contact surfaces. The conductive pathway of the first panel is in spaced relation to at least one of the first and second contact surfaces of the second panel when the first and second panels are in the first position. The conductive pathway bridges the first and second contact surfaces when the first and second panels are in the second position to thereby permitting electrical communication between said first and second contact surfaces.

Another aspect of the present invention relates to a package comprising at least one contact panel having a conductive pathway. At least one circuit panel having a first conductive contact surface and a second conductive contact surface spaced apart from one another so as to prevent electrical communication between the first conductive contact surface and the second conductive contact surface. At least one blister cavity is capable of having an article therein is positioned relative to the contact panel such that dispensing the article from the blister cavity causes the conductive pathway to bridge the first and second conductive surfaces and to thereby permit electrical communication between the contact panel and the circuit panel.

Yet another aspect of the invention relates to a blank used to form a package. The package comprises first, second, and third score lines which divide the blank into at least one contact panel, at least one circuit panel, at least one blister panel, and at least exterior panel. The contact panel and the circuit panel are formed by the first score line. The blister panel and exterior panel are formed by the second score line. Third score line delimit the circuit panel and exterior panel from one another. The contact panel having at least one swing door is configured to pivot with respect to the contact panel. The circuit panel has at least one punch out therein. The exterior panel have at least one tear away door therein, and the blister panel have at least one punch out that is configured to receive a blister pack protruded therefrom and wherein the at least one contact panel, the at least one circuit panel, the at least one blister panel, and the at least exterior panel cooperate with one another to construct the package.

BRIEF DESCRIPTION OF THE DRAWINGS

A full understanding of the invention can be gained from the following description of the preferred embodiments when read in conjunction with the accompanying drawings in which:

FIG. 3B is a close-up view of a portion of FIG. 3A illustrating an enlarged front view of one swing door;

FIG. 3C is a close up view of a portion of FIG. 3A illustrating the swing door being positioned within in a plane of the contact panel;

FIG. 3D is a close-up view of a portion of FIG. 3A illustrating the swing door being positioned out of the plane of the contact panel;

FIG. 9A is an exploded perspective view of one blister pill unit of the package assembly in FIG. 1;

FIG. 9B is a partial perspective view of the blister pill unit shown in FIG. 9A;

DETAIL DESCRIPTION OF THE INVENTION

Figure 1:
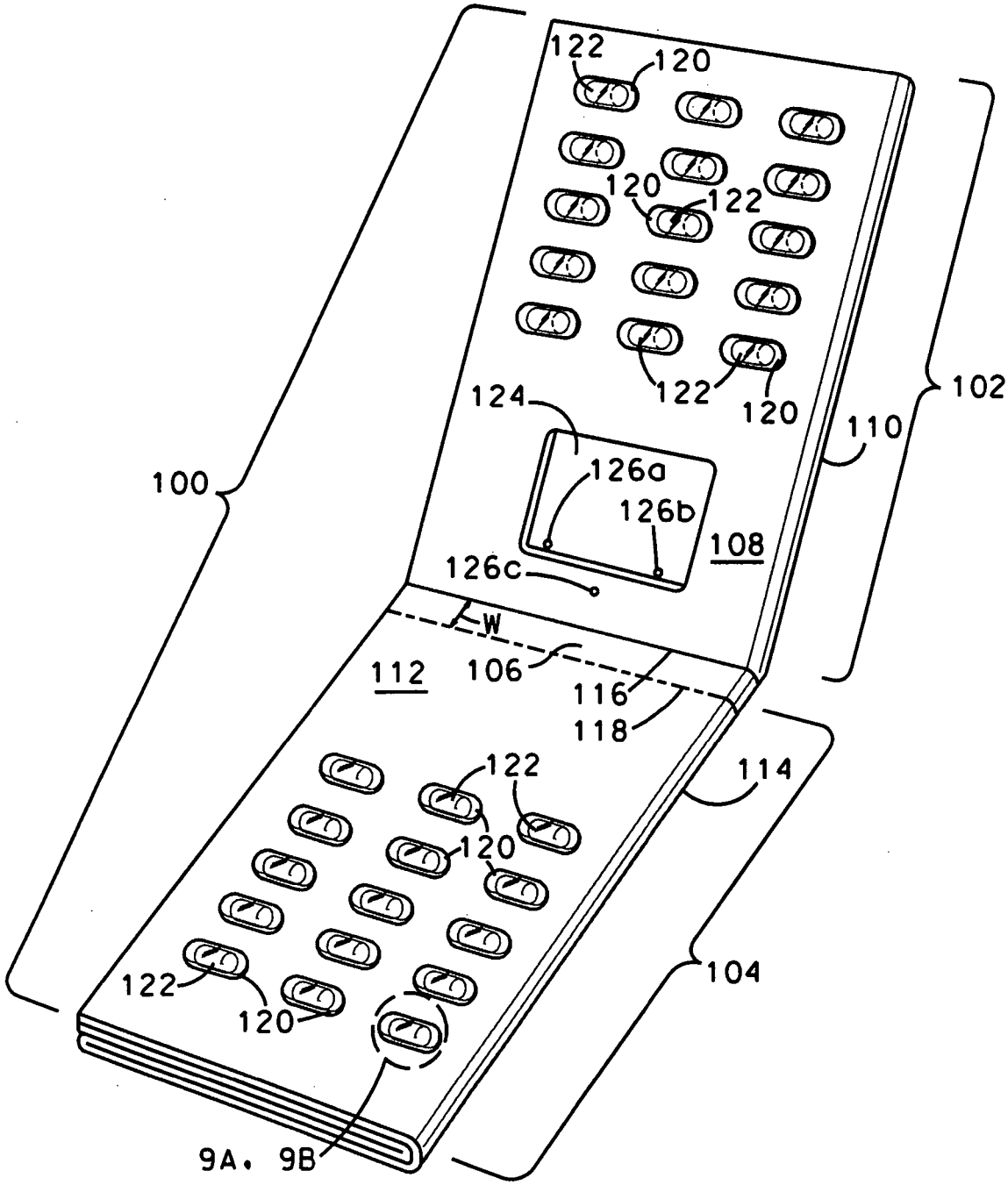
FIG. 1 is a perspective view of a package assembly adapted for use with pharmaceutical articles in accordance with a preferred embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 is a perspective view of a package assembly 100 adapted for use generally with pharmaceutical articles in accordance with the preferred embodiment of the present invention. The pharmaceutical articles used in the package assembly 100 are, for example, capsules, tablets, and/or pills for controlled indication of dispensing of the pharmaceutical articles from the package assembly 100. Although the package assembly 100 is used for storing capsules, tablets, and/or pills, but one of ordinary skill in art would appreciate that the package assembly 100 may be used for variety of other consumer products such as battery, electronic devices, candy and other foodstuffs.

Figure 7A:
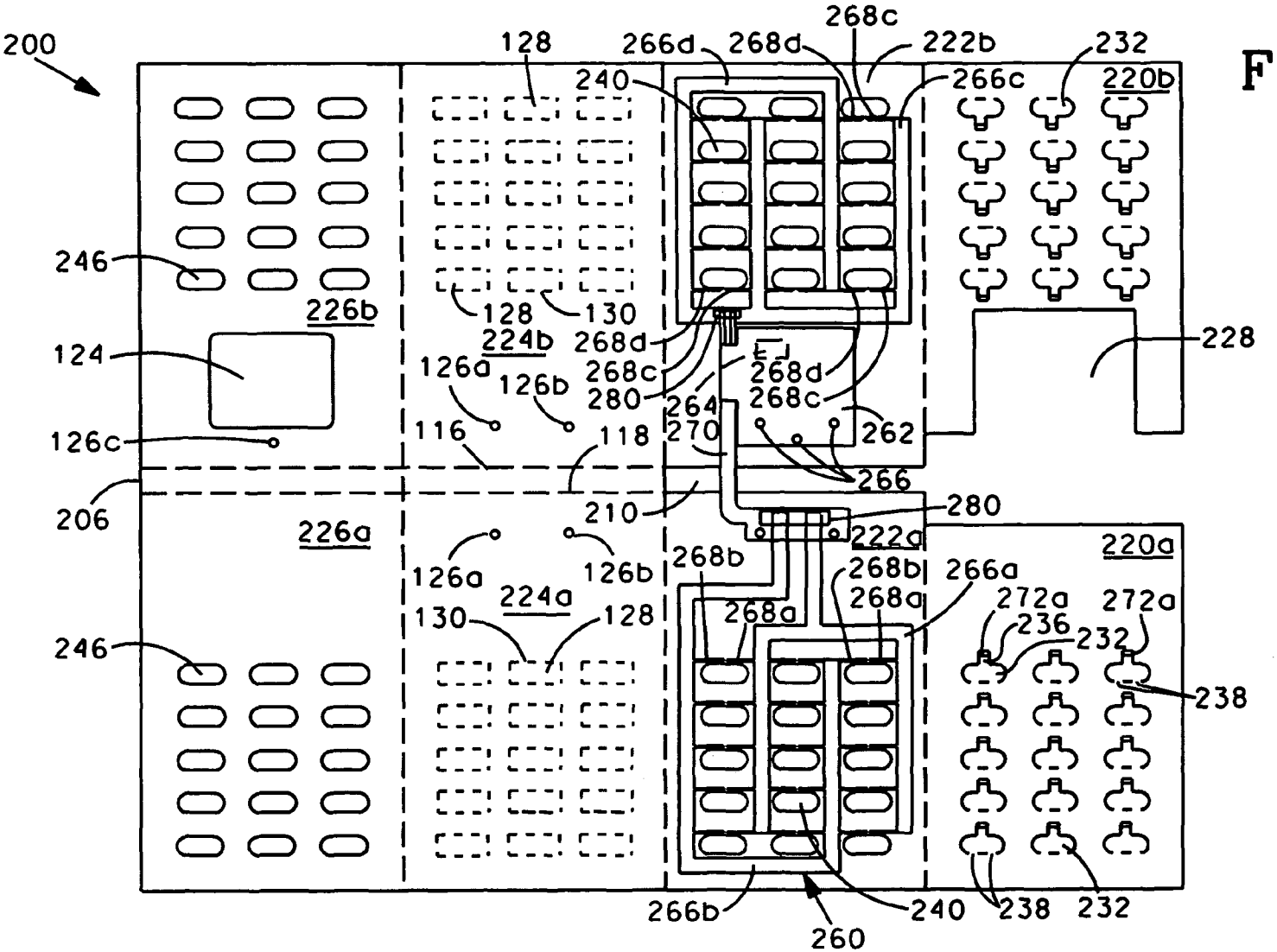
FIG. 7A is a plan view of the blank shown in FIG. 3A, further including a circuitry unit applied to the circuit panels.
Figure 7B:
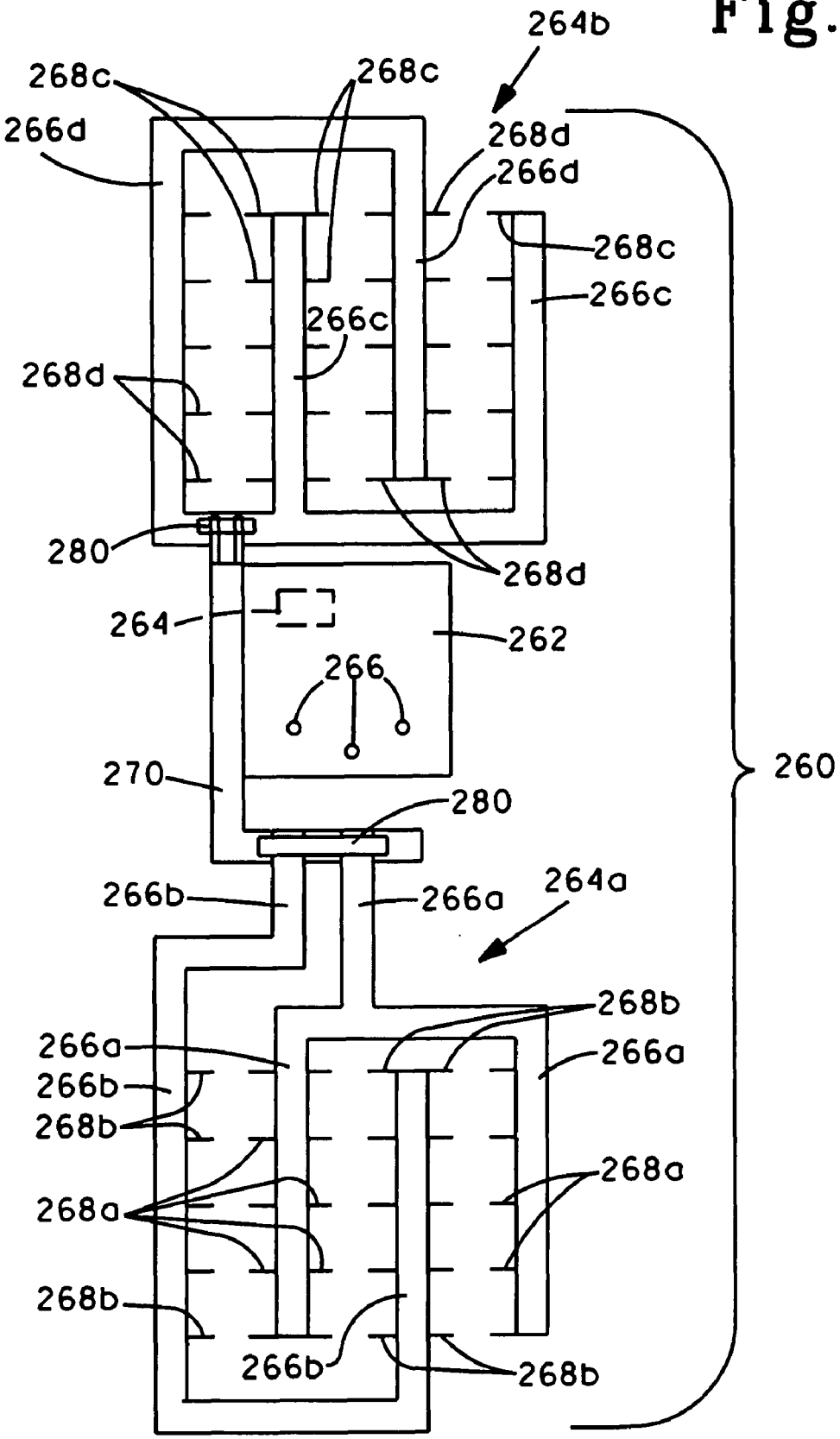
FIG. 7B is a detail view of the circuitry unit shown in FIG. 7A.

The package assembly 100 includes a first portion 102 and a second portion 104 which are integrally attached to one another by a ridge 106. The first portion 102 includes a front side 108 and a back side 110. Similarly, the second portion 104 includes a front side 112 and a back side 114. The ridge 106 is defined by, not limited to, two substantially parallel non-continuous score lines 116 and 118. The width (W) of the ridge 106 is generally corresponds to the thickness of the first and second portions 102, 104 and will be described in greater detail below. Each of the respective first and second portions 102,104 respectively includes a blister pack 250 (not entirely visible in FIG. 1) having a 2D matrix of blister cavities 120. It should be noted that the present invention is not limited to the 2D matrix of blister cavities, and depends on the needs of a user; the blister pack 250 can be any number of matrix. Blister pack 250 is shown more clearly in FIG. 5. At least one blister pack 250 is sandwiched between front and back sides 108, 110 respectively in the first portion 102 and at least one blister pack 250 is sandwiched between front and back sides 112, 114 respectively in the second portion 104. Each of the blister cavities 120 protrudes from the respective front sides 112, 114 of first portion 102 and the second portion 104. Each blister cavity 120 is sized to receive a pill 122 therein. Opening 124 in the first portion 102 is provided to receive a microprocessor 262 (FIGS. 7A, 7B). The microprocessor 262 operates in corporation with a momentary switch, as described hereinafter to permit the accessing of the pill 122 in each blister cavity 120. Holes 126*a*, 126*b* are also provided to place light emitting diodes (LEDs) that are part of a circuitry unit 260 (FIG. 7B) of the package assembly 100. The holes 126*a*, 126*b* are located on the back side 110 and are exposed through the opening 124 of the front side 112.

The first portion 102 and the second portion 104 preferably connected to one another by ridge 106, although they may also be attached together by any suitable means including, but not limited to, by adhesives or mechanical means such as, for example, snapping connections, and inserting the tab on one portion into the slot of the second portion or vice versa. It should be noted that the first portion 102 and the second portion 104 can be separated and used individually without compromising the integrity and the function of the package assembly 100. When the first portion 102 and the second portion 104 are separated, each portion 102, 104 would include a separate circuitry unit. Generally, the size of the package assembly 100 depends on the number of pills 122 stored in the package assembly 100. The first portion 102 and the second portion 104 are preferably made of paper, paperboard, or cardboard, but any other suitable material may be used as well. The package assembly 100 is portable, easy to use, inexpensive, and effectively assists a patient in following a prescribed regimen for taking medication.

Figure 2:
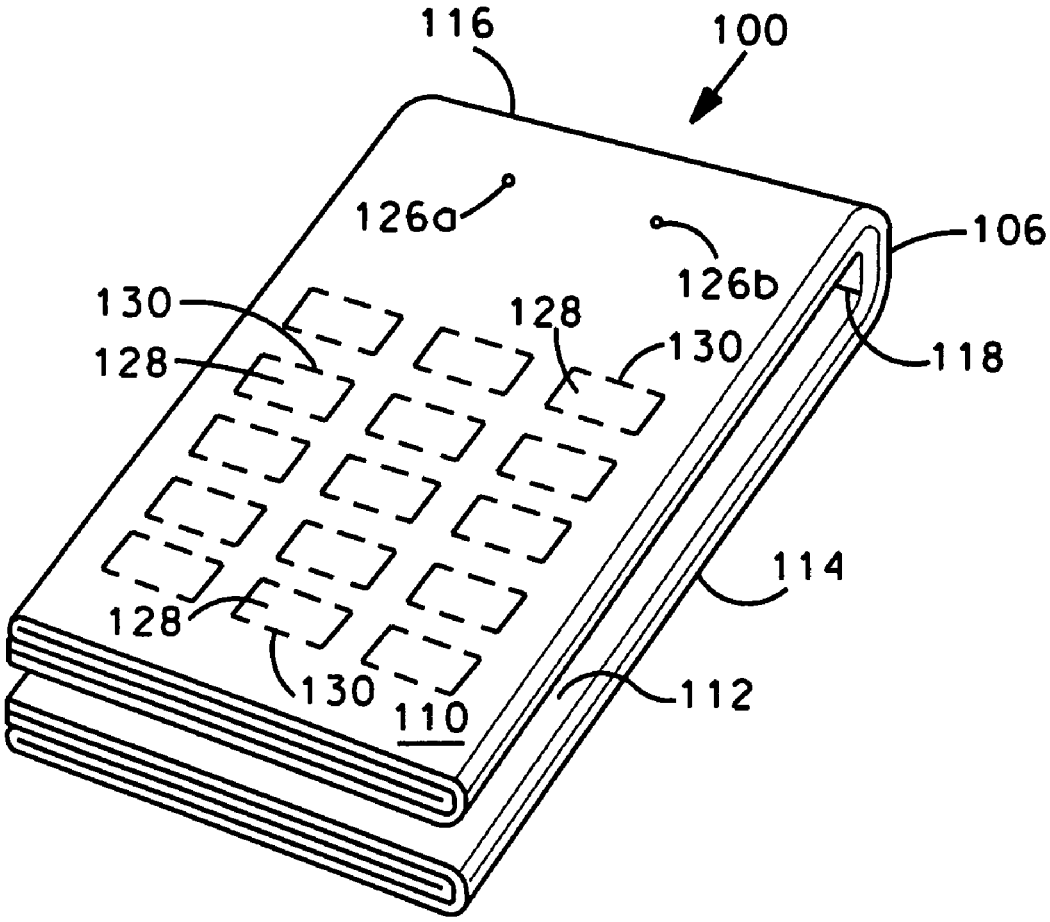
FIG. 2 is a perspective view of the package assembly shown in FIG. 1, illustrating the package assembly in a folded position.
Figure 8:
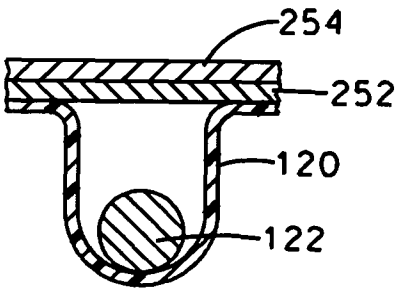
FIG. 8 is a sectional view of one blister pack shown along line 8-8 of FIG. 7D.

FIG. 2 illustrates the package assembly 100 of FIG. 1 which is folded in half. When folded in half, the package assembly 100 resembles a book. As noted above, the width (W) of the ridge 106 is provided to compensate for the thickness of the blister pack 250 and the circuitry unit 260 disposed therein. When the package assembly 100 is in the folded position, the ridge 106 permits the first and second portions 102, 104 to fold onto one another with ease and prevents possible tearing of non-continuous score lines 116 and 118 in the folded area. As will be appreciated from viewing FIGS. 1 and 2, the back side 110 of the first portion 102 includes a 2D matrix of tear away doors 128 that are each defined by non-continuous score lines 130. The 2D matrix of tear away doors 128 are aligned with the corresponding blister cavities 120 when the blister pack 250 is positioned relative to the tear away doors 128 as shown in FIG. 1. The function and use of the tear away doors 128 are best understood by reference to FIGS. 3, 8 and 9, and will be described in greater detail hereinafter.

Figure 3A:
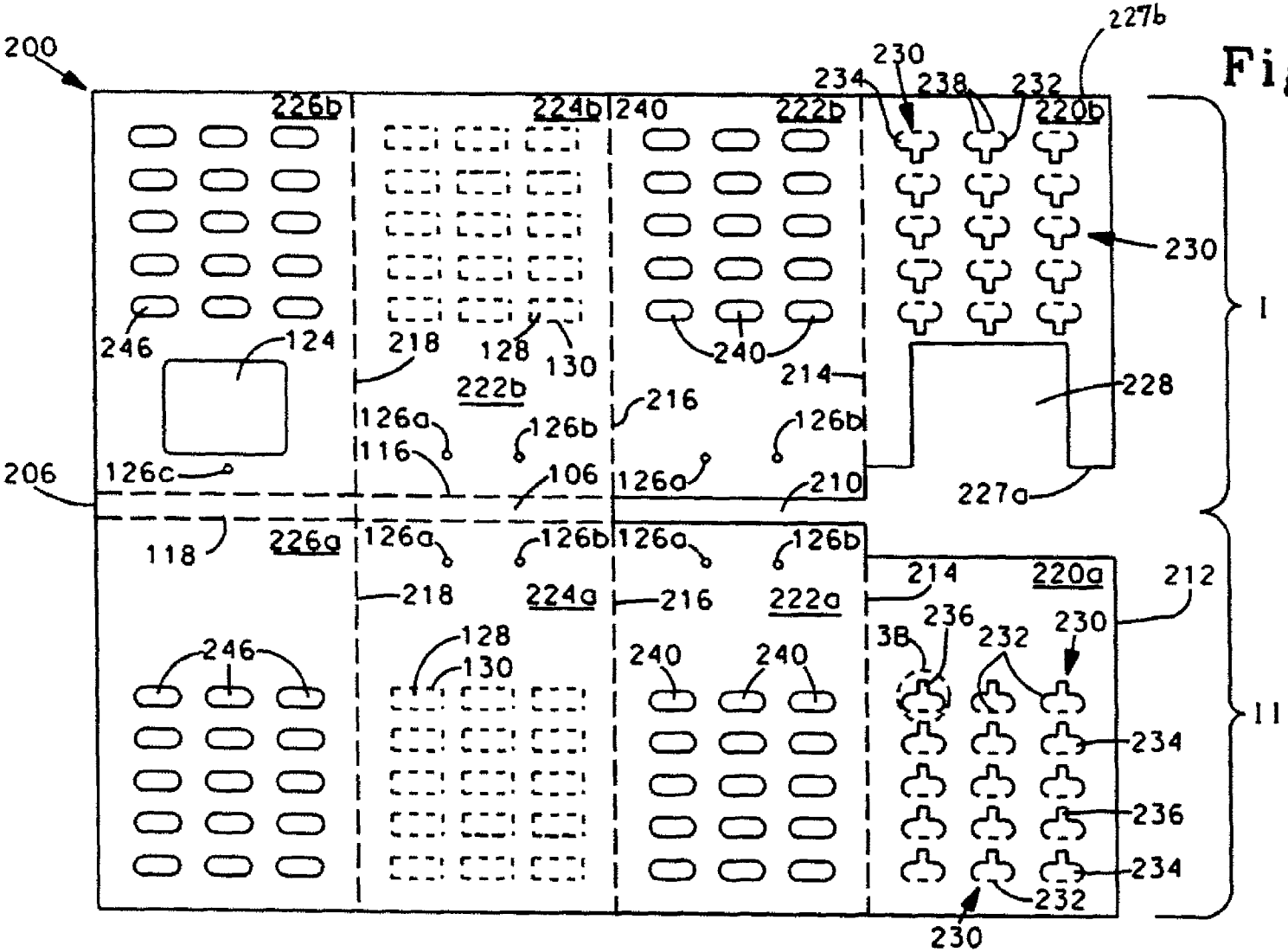
FIG. 3A is a plan view of a blank used to form the package assembly shown in FIG. 1.

FIG. 3A is a plan view of a blank 200 used to form the package assembly 100 of FIG. 1 in accordance with the preferred embodiment of the present invention. The blank 200 is constructed from any suitable foldable material, such as paperboard that can be die-cut to form a generally rectangular configuration when the blank 200 is in the unfolded position. It is well within the scope of this invention to use any suitable material well known or later developed in the art such as, for example, paper, plastic, or the like. The blank 200 is divided into section I and section II by two longitudinal non-continuous score lines 116,118 extended along the length of the blank 200. It will be appreciated that the practice of this invention permits the section I and section II be separated from the one another so that each section I or section II can be folded to form a package assembly that would function in substantially the same manner as the package assembly 100 described herein.

In the exemplary embodiment of FIG. 2, when the blank 200 is folded, respective sections I and II are defined by respective first and second portions 102, 104. The longitudinal non-continuous score lines 116, 118 are extended from left edge 206 of the blank 200 to the central portion of the blank 200. The non-continuous score lines 116 and 118 are substantially parallel and cooperate with one another to form the ridge 106, as described above. A cut out 210 is formed from the central portion of the blank 200 to the right edge 212 of the blank 200. Transverse non-continuous score lines 214, 216, and 218 extend along the width of the blank 200 and cooperate with the longitudinal non-continuous score lines 116 and 118 to define a total of eight panels which are namely, two opposing contact panels 220*a*, 220*b*, two opposing circuit panels 222*a*, 222*b*, two opposing exterior panels 224*a*, 224*b*, and two opposing blister panels 226*a*, 226*b*. The central portion of the blank 200 is defined by intersection of non-continuous score lines 116,118 with the transverse non-continuous score line 216. It should be noted that the number of panels illustrated in FIG. 3 is strictly exemplary in nature and is in no way intended to limit the number of panels in the package assembly 100.

The contact panel 220*b* includes a rectangular cut out 228 which extends from an inner edge 227*a* of the panel 220*b* toward the outer edge 227*b* of the panel 220*b*. In the exemplary embodiment of FIG. 3A, the contact panel 220*a* may have a cut out similar to the cutout 228 provided in contact panel 220*b*, in which the two panels 220*a*, 220*b* would be identical but opposing one another. The blister panel 226*b* includes the opening 124 which cooperates with the cut out 228 to permit the microprocessor 262 (FIG. 7A) to be exposed from the blister panel 226*b* when the blank 200 is folded to form the package assembly 100 as depicted in FIG. 1. It should be noted that the cut out 228 and the opening 124 are not critical to the practice of the invention. In the absent of the cut out 228 and the opening 124, the circuitry unit 260 is concealed between the blister panel 226*a* and contact panel 220*a* when the blank 200 is in the folded position as shown in FIG. 1.

Each of the contact panels 220*a*, 220*b* includes a 2D matrix of individual swing door 230 that are each defined by non-continuous score lines 232. FIG. 3A illustrates a total of fifteen swing doors 230 that are substantially oblong in shape and positioned approximately in the center of contact panels 220*a*, 220*b*. It should be noted that the number of swing doors 230 shown in FIG. 3A is strictly exemplary in nature and is in no way intended to limit the number of swing doors 230 that can be included in the package assembly 100. Furthermore, each swing door 230 preferably stands alone and is not connected with another swing door 230.

Referring to FIGS 3B-3D, each of the swing doors 230 are defined by the non-continuous score line 232 having generally an oval body portion 234 with a generally rectangular tab 236 projected outwardly from the long side of the swing door 230. The non-continuous score line 232 is interrupted by a pair of nicks 238 so as to hold the swing door 230 to the contact panel 220*a* and to permit the swing door 230 to pivot in and out of the pin of panel 220*a* as best depicted in FIG. 3D. An ordinary skill in the art would appreciate that the pair of nicks 238 functions like a typical door hinges which permit the swing door 230 to pivot along an axis aligned with a second long side of the generally oval portion 234 opposite the tab 236.

Each of the circuit panels 222*a* includes a 2D matrix of punch outs 240 that correspond to the number of swing doors 230 in the contact panels 220*a*. Each of the punch out 240 is aligned with the corresponding swing door 230 to be used in forming an electronic momentary switch 290 (shown in FIGS. 9A, 9B, 10A-C) when the blank 200 is in the folded position. The function and use of the momentary switch 290 are best understood by reference to FIGS. 10A-10C and will be described in greater detail later. The punch outs 240 are positioned approximately in the center of circuit panels 222*a*, 222*b*. It should be noted that the number of punch outs 240 shown in FIG. 3A is strictly exemplary in nature and is in no way intended to limit the number of punch outs 240 that can be included in the package assembly 100. Furthermore, each punch outs 240 preferably stands alone and is not connected with another punch out 240. Although the punch outs 240 are illustrated as being oval, it should be noted that it is within the scope of this invention to provide punch outs 240 of any known shape, such as, for example, but not limited to, rectangular, circular, triangular, trapezoidal, square, and the like.

Each of the exterior panels 224*a*, 224*b* includes a 2D matrix of tear away doors 128 that are each defined by non-continuous score lines 130. The exemplary embodiment of FIG. 3A illustrates a total of fifteen tear away doors 128 that are substantially rectangular in shape and disposed approximately in the center of the exterior panels 224*a*. The shape of each tear away door 128 being rectangular is merely exemplary and it is within the scope of this invention to use any known shape to define the tear away doors 128, such as, but not limited to, circular, oval, square, triangular, trapezoidal, and the like. The tear away doors 128 are aligned with the punch outs 240 in the circuit panels 222*a*, 222*b* when the blank 200 is in the folded position. It should be noted the number of tear away doors 128 illustrated is strictly exemplary in nature and is in no way intended to limit the number of tear away doors 128 that can be included in the assembly package 100. Furthermore, each tear away door 128 stands alone and is not connected with another tear away door 128. The exterior panels 224*a*, 224*b* form the back surface of the package assembly 100 when the contact panels 220*a*, 220*b*, circuit panels 222*a*, 222*b*, and the blister panels 226*a*, 226*b* are folded onto one another. The back surface 110 of the package assembly 100 may also be used to print, for example, a doctor's instruction, pharmacists' instructions, graphics, comments and the like.

Figure 5:
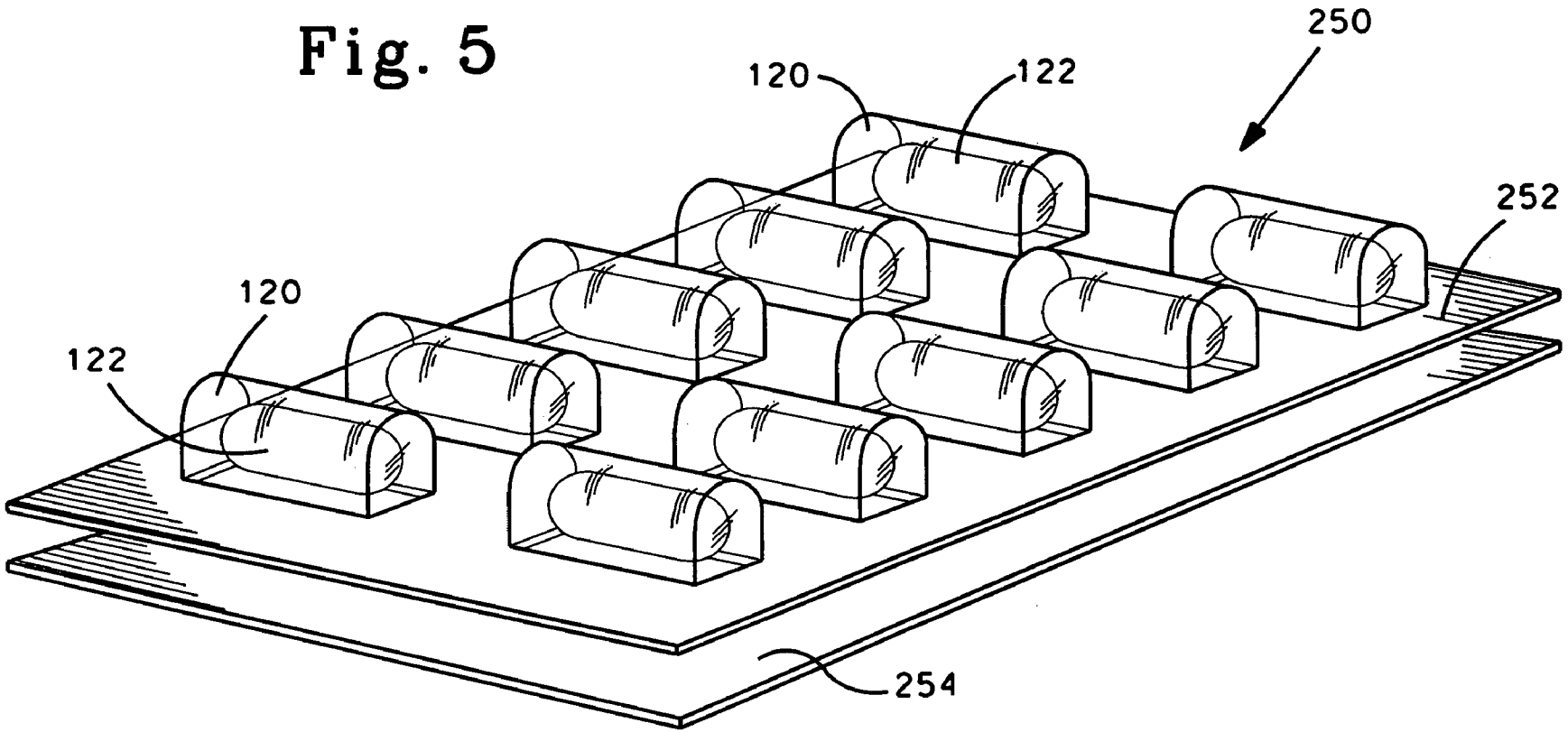
FIG. 5 is an exploded perspective view of a blister cavity with pills therein in spaced relation to a foil layer used to seal the blister pack in accordance to one embodiment of the present invention.

Each of the blister panels 226*a*, 226*b* includes a 2D matrix of punch outs 246 that correspond to the number of the respective tear away doors 128, punch outs 240 and swing doors 230 when the blank 200 is in the folded position. When the contact panels 220*a*, 220*b*, circuit panels 222*a*, 222*b*, and the exterior panels 224*a*, 224*b* are folded onto one another, the respective blister panels 226*a*, 226*b* form the front surfaces 112, 108 of the package assembly 100 as best shown in FIG. 1. The 2D matrix of punch outs 246, in the blister panels 226*a*, 226*b*, receives a corresponding 2D matrix of the blister cavity 120 as best depicted in FIG. 5. The punch outs 226*a*, 226*b* are positioned approximately in the center of blister panels 226*a*, 226*b*. It should be noted that the number of punch outs 246 shown in FIG. 3A is strictly exemplary in nature and is in no way intended to limit the number of punch outs 246 that can be included in the package assembly 100. Furthermore, each punch outs 246 preferably stands alone and is not connected with another punch out 246. Although the punch outs 246 are illustrated as being oval, it should be noted that it is within the scope of this invention to provide punch outs 246 of any known shape, such as, for example, but not limited to, rectangular, circular, triangular, trapezoidal, square, and the like.

Figure 4A:
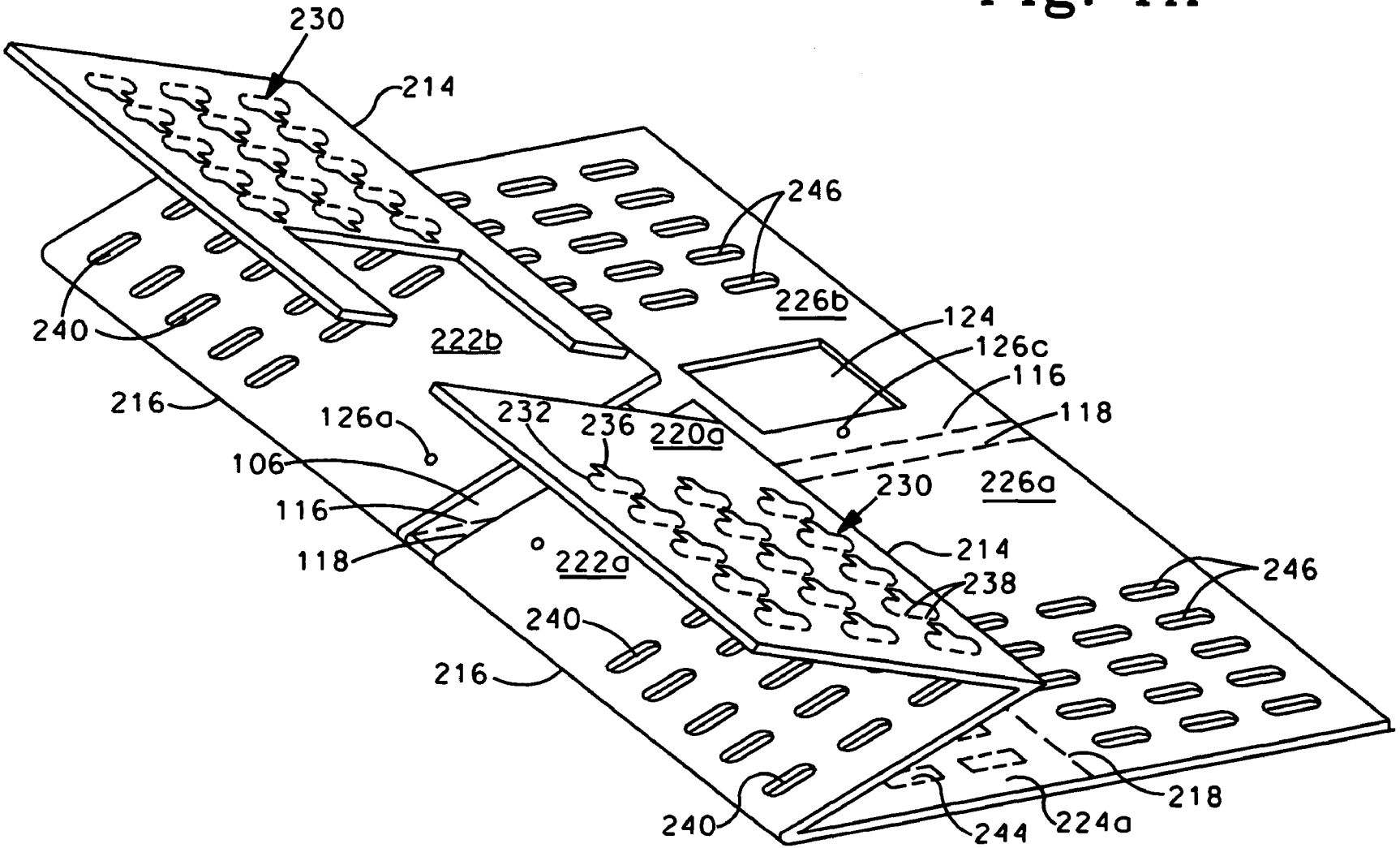
FIG. 4A is a perspective view of the blank in FIG. 3A illustrating the blank in a configuration partially folded.
Figure 4B:
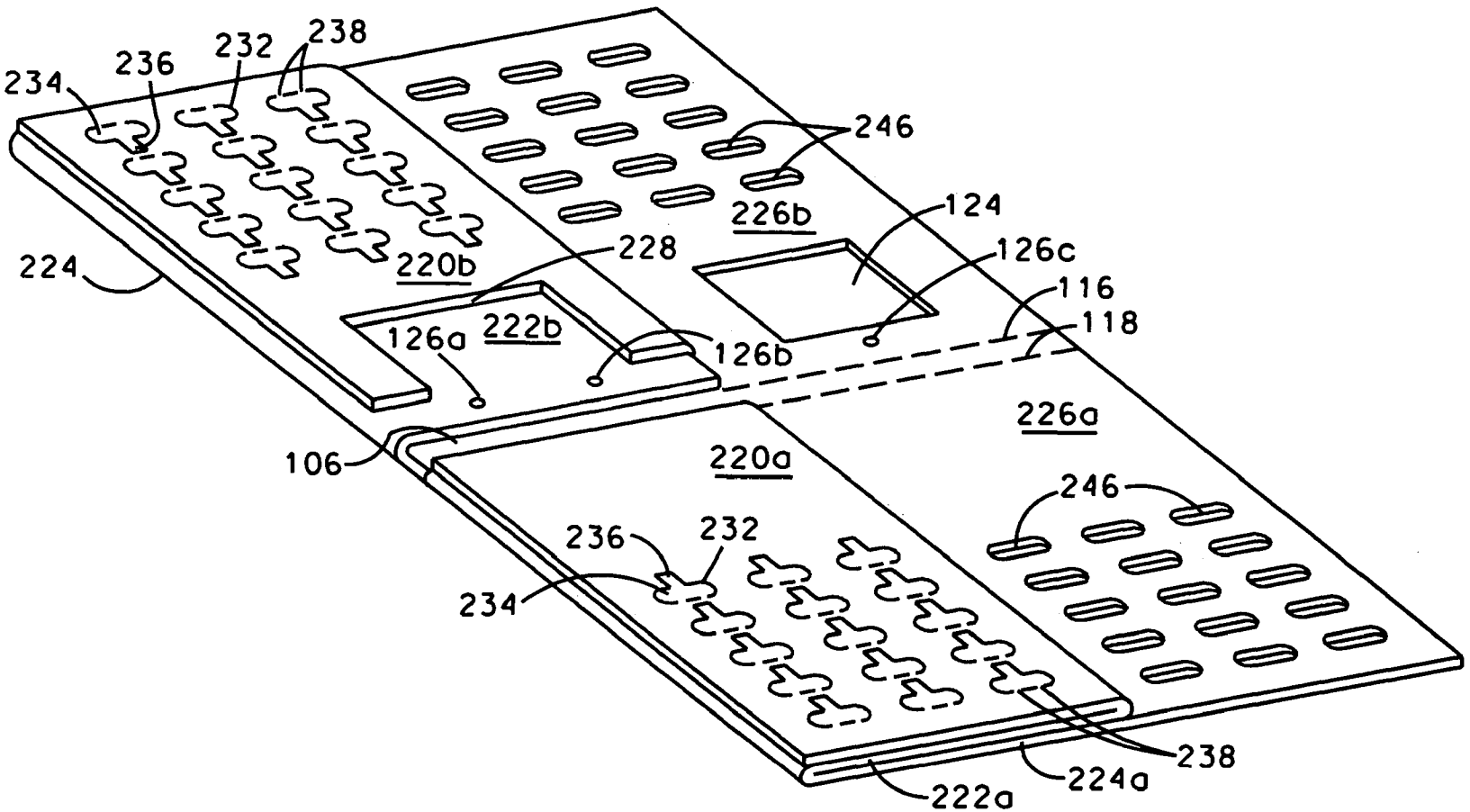
FIG. 4B is a perspective view of the blank in FIG. 3A illustrating circuit and contact panels each being folded onto one of a plurality of exterior panels.

FIG. 4A illustrates the manner in which the blank 200 of FIG. 3 is folded. Non-continuous score line 216 enables circuit panels 222*a*, 222*b* to be folded onto the exterior panels 224*a*, and 224*b*. Similarly, Non-continuous score line 214 enables contact panels 220*a*, 220*b* to be folded onto the circuit panels 222*a*, 222*b*. It should be noted that circuit panels 222*a*, 222*b* are sandwiched between the contact panels 220*a*, 220*b* and the exterior panels 224*a*, 224*b* as best depicted in FIG. 4B.

Figures 6A, 6B:
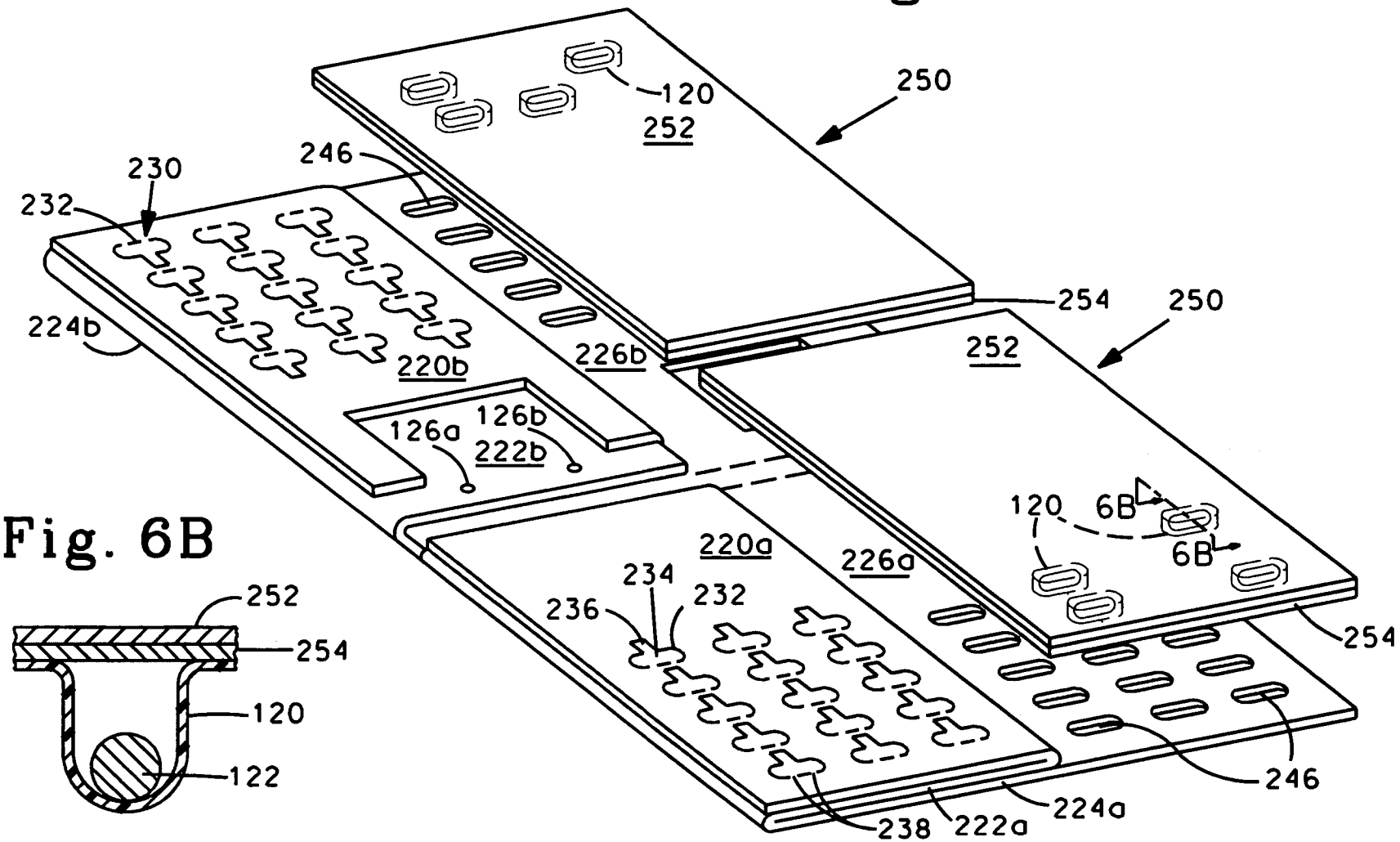
FIG. 6A is an exploded view of the blank shown in FIG. 4B and a pair of blister packs each facing downwardly towards one of the plurality of blister panels.
FIG. 6B is a partial sectional view of one blister pack shown along line 6B-6B of FIG. 6A.

FIG. 6A illustrates an exploded view of the blank 200 and a pair of blister packs 250. The blank 200 is partially folded and the pair of blister packs 250 is positioned over the blister panels 226*a*, 226*b*. The pair of blister packs 250 is placed onto the blister panels 226*a*, 226*b* such that each of the blister cavities 120 protrudes from the punch outs 246 of the blister panels 226*a*, 226*b* as best depicted in FIG. 1. Then, the non-continuous score line 218 enables blister panels 226*a*, 226*b* to be folded onto the contact panels 220*a*, 220*b* along the non-continuous score line 218. It should be noted that the scope of this invention is not limited to the order of the above-described sequence of steps for folding the respective panels 220*a*, 220*b*, 222*a*, 222*b*, 224*a*, 224*b*, 226*a* and 226*b* onto each other. For example, depends on the number of panels to be folded, every permutation of possible folding sequences regarding the panels 220*a*, 220*b*, 222*a*, 222*b*,

224*a*, 224*b*, 226*a* and 226*b* along non-continuous score lines 214, 216, and 218 is considered to be within the scope of this invention.

For illustrative purposes, only a few blister cavities 120 is depicted in FIG. 6A, but generally the number of blister cavities 120 corresponds to the number of punch outs 246. Moreover, FIG. 6A depicts only two blister packs 250, but this invention can be practiced with any number of blister packs 250 and therefore, the two blister packs 250 are shown by way of example. Since the two blister packs 250 are substantially similarly, only one of the blister pack 250 is described below.

The blister pack 250 shown in FIG. 5 includes a blister layer 252 formed into a 2D matrix of blister cavities 120 which each cavity receives the pill 122. A foil layer 254 is adhered to the blister pack 250 in a conventional manner. The blister layer 252 defines the top of the blister cavities 120 and is preferably a vinyl or PVC material, but can be any suitable material. The blister cavities 120 are preferably, but need not be, transparent so that the pill 122 housed by the blister cavity 120 can be seen. Although the blisters cavities 120 can take any orientation, size or shape, the blister cavities 120 are preferably oriented, sized, and shaped to correspond to the orientation, size, and shape of the pills 122. For example, in the embodiment shown in FIG. 5, the blister cavities 120 are oblong for housing a generally oblong pill 122 and the blister cavities 120 is slightly larger than the pills 122, so that the pills 122 will fit within the blister cavities 120 but will not be able to have a significant amount of room to move. Each blister cavity 120 is tear resistant, such that a pill 122 housed in the blister cavities 120 cannot be accessed by tearing the blister layer 252 without substantial effort or the use of a blade. It will be appreciated that a pill 122 can be removed from the blister cavity 120 by pushing the blister cavity 120 and forcing the pill 122 to punch a hole in the foil layer 254 so that the pill 122 can be removed via the punched hole.

FIG. 7A is a plan view of the blank 200 having the circuitry unit 260 disposed therein and is used to form the package assembly 100 of FIG. 1 in accordance with the preferred embodiment of the present invention. The circuitry unit 260 is configured to be printed on circuit panels 220*a*, 220*b* of the blank 200. As noted above, the circuitry unit 260 in corporation with a momentary switch 290, as described hereinafter, permits the accessing of the pill 122 in each blister cavity 120 to be monitored. As best illustrated in FIG. 7B, the circuitry unit 260 comprises a microprocessor 262 having an audible piezo-alarm 264 and a light emitting diode 266, conducting circuits 264*a*, 264*b*, and other components such as a read-only-memory and a read-access-memory to keep track of the time to take the pill 122 and alert a patient if the pill 122 was not taken at the appropriate time. The microprocessor 262 may adhesively attached to the circuit panel 222*b*. The microprocessor 262 communicates with the package assembly 100 via conductive circuits 264*a*, 264*b*. Alternatively, one skilled in the art would appreciate that microprocessor 262 may be in optical communication with the package assembly 100. The respective conductive circuits 264*a*, 264*b* preferably consists of respective electrically conductive pathways 266*a* 266*b* and 266*c*, 266*d* that are printed, for example, graphically in the form of printing ink or applied by another method, for example, in the form of foil, onto the circuit panels 222*a* and 222*b* as best depicted in the FIG. 7A.

Each of the conductive pathways 266*a*, 266*b* and 266*c*, 266*d* is configured to form a generally U-pattern conductive pathway. In the exemplary embodiment, the respective U-shaped conductive pathways 266*a*, 266*b* and 266*c*, 266*d* are generally intertwined to minimize the space needed to print the conductive pathways 266*a*, 266*b* and 266*c*, 266*d* on their respective circuit panel 222*a* and 222*b*. The conductive circuits 264*a*, 264*b* functions similarly to that used, for example, in parallel switches. It will be appreciated that the parallel pattern configuration of conductive pathways 266*a*, 266*b* and 266*c*, 266*d* are only exemplary and by no means limited to parallel pattern. It is well within the scope of this invention that the conductive pathways 266*a*, 266*b* and 266*c*, 266*d* form other geometrical patterns with one another. Each of the conductive pathways 266*a*, 266*b* includes a plurality of conductive contact surfaces 268*a* and 268*b*. Similarly, each of the conductive pathways 266*c*, 266*d* includes a plurality of conductive contact surfaces 268*c* and 268*d*. In the exemplary embodiment of FIG. 7A, the parallel pattern of the conductive circuits 264*a*, 264*b* correspond to the 2D matrix of the punch outs 240 contained in the circuit panels 222*a*, 222*b*. For example, in the circuit panel 222*a*, each punch out 240 includes a pair of contact surfaces 268*a*, 268*b* that is printed on one of the long sides of the punch out 240. Alternatively, the pair of contact surfaces 268*a*, 268*b* may be printed on one of the short sides of the punch out 240, provided that the respective conductive contacting surfaces 272*a*, 272*b* are reconfigured such that the pair of contact surfaces 268*a*, 268*b* is symmetric with respect to the contacting surfaces 272*a*, 272*b*. For example, if the contact surfaces 268*a*, 268*b* are printed on one of the short sides of the punch out 240, then the respective conductive contacting surfaces 272*a*, 272*b* are also printed on the short side of the respective swing doors 230. The conductive contact surfaces 268*a*, 268*b* are spaced apart from one another as best shown in FIG. 7B. It should be noted that all of the contact surfaces 268*a*, are branched out from the conductive pathway 266*a* and the entire contact surface 268*b*, are branched out from the conductive pathway 266*b*. Similarly, in the circuit panel 222*b*, each punch out 240 includes a pair of contact surfaces 268*c*, 268*d* that are printed on one of the long sides of the punch out 240. The contact surfaces 268*c*, 268*d* are spaced apart from one another as best shown in FIG. 7B. It should be noted that all the contact surface 268*a* are branched out from the conductive pathway 266*a* and the entire conductive contact surface 268*b* are branched out from the conductive pathway 266*b*. It should be noted that the parallel configuration of conductive pathways 266*a*, 266*b* and 266*c*, 266*d* substantially reduces the number of the electrical contacts needed to communicate with the microprocessor 262.

The conductive paths 266*a*, 266*b* are connected to the microprocessor 262 via a flexible circuit 270. The flexible circuit 270, due to its inherent toughness can resist a multiple folding without any damage to the wires. The flexible circuit 270 is connected to the conducting pathways 266*a*, 266*b* and 266*c*, 266*d* by a Z directional electrically conductive tape 280. The Z directional electrically conductive tape 280 is similar to a two sided tape that conducts electricity only up and down through its thickness "z-direction" as well known in the art. The Z directional conductive tape 280 does not conduct across the surface of the circuit panels 222*a*, 222*b* in the X and Y directions. Advantageously, the Z directional conductive tape 280 could be applied over two conductive traces that are next to each other without connecting them to each other or "shorting them out". One ordinary skilled in the art would appreciate that a Z directional conductive adhesive may be used for the practice of the present invention. The Z directional conductive tape 280 is also known as anisotropic electrically conductive tape. Alternatively, It should be noted that a standard conductive adhesive may be applied over two conductive traces that are next to each other, however, one ordinary skill in the art would know that the standard conductive adhesive have to be applied in a manner that a small amount is applied to each conductive trace so it would not spread out and touch the other adjacent contact surfaces 268*a*, 268*b* and 268*c*, 268*d*. It should be noted that contact surface 266*a* can not be connected to contact surface 266*b* and contact surface 266*c* can not be connected to contact surface 266*d*.

The microprocessor 262 is programmed to keep track of the time to take the pill and alert a patient if the pill 122 was not taken at the appropriate time. The microprocessor 262 may be programmed to establish a desired pill schedule and to store in the memory the actual dispensing times of the pills 122. The audible piezo-alarm 264 sounds to indicate to the patient that it is time to take the pill according to the programmed pill schedule. The microprocessor 262 may be programmed to alert the patient to administer a pill every fixed time interval. The microprocessor 262 may also be programmed to keep track of the untaken pills by the patient. The light emitting diode (LED) 266 is a semiconductor that emits light when eclectically energized. The light emitting diode (LED) 266 acts as tiny light bulb and used as a small indicator light to alert a patient.

The swing doors 230 on the respective contact panels 220*a*, 220*b* receive respective conductive contacting surface 272*a*, 272*b*. As described above, each swing door 230 includes the oval portion 234 with the rectangular tab 236 projected outwardly from the long side of the swing door 230. The conductive contacting surface 272*a* is applied at the tip of the rectangular tab 236. Similarly, the conductive contacting surface 272*b* is applied at the tip of the rectangular tab 236*b*. Although the tab 236 is illustrated as being rectangular, it should be noted that it is within the scope of this invention to provide tab 236 of any known shape, such as, for example, but not limited to, circular, triangular, trapezoidal, square, and the like.

The respective conductive contacting surfaces 272*a*, 272*b* are in electrical communication with the respective conductive contact surfaces 268*a*, 268*b* and 268*c*, 268*d*, when the tip of the rectangular tab 236 slides over the conductive contact surfaces 268*a*, 268*b* and 268*c*, 268*d*.

Figure 7C:
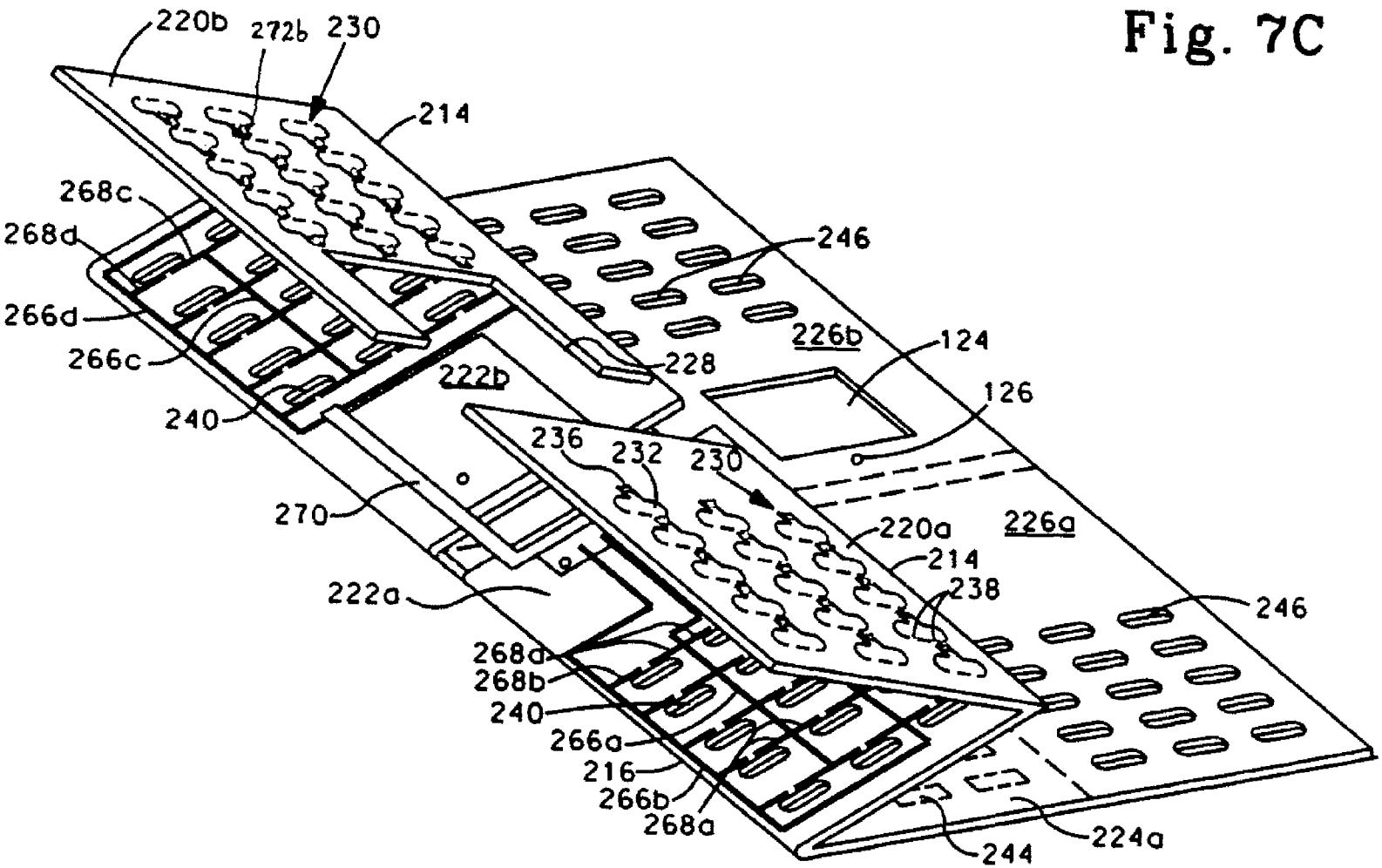
FIG. 7C is a perspective view of the blank in FIG. 7A illustrating the blank in a configuration partially folded.

FIG. 7C illustrates the manner in which the blank 200 of FIG. 7A is folded. The blank 200 in FIG. 7A is folded exactly in the same manner as the exemplary embodiment described above with reference to FIG. 4A. With the exception of the circuitry unit 260 in circuit panels 222*a*, 222*b* and the conductive contacting surfaces 272*a*, 272*b* in the contact panels 220*a*, 220*b*, which are added to the blank 200 of FIG. 3A, the two exterior panels 224*a*, 224*b*, and two blister panels 226*a*, 226*b* in FIG. 7C are identical to that of FIG. 4A. As such, a detailed discussion of these panels will be omitted to avoid redundancy. It should be noted that in FIG. 7B, when the contact panels 220*a*, 220*b* overlay the circuit panels 222*a*, 222*b*, each of the respective swing doors 230 in cooperation with each of the punch out 240 forms a momentary switch 290 that is in an open position. The function and use of the momentary switch 290 are best understood by reference to FIGS. 10A-10C and will be described in greater detail later.

Figure 7D:
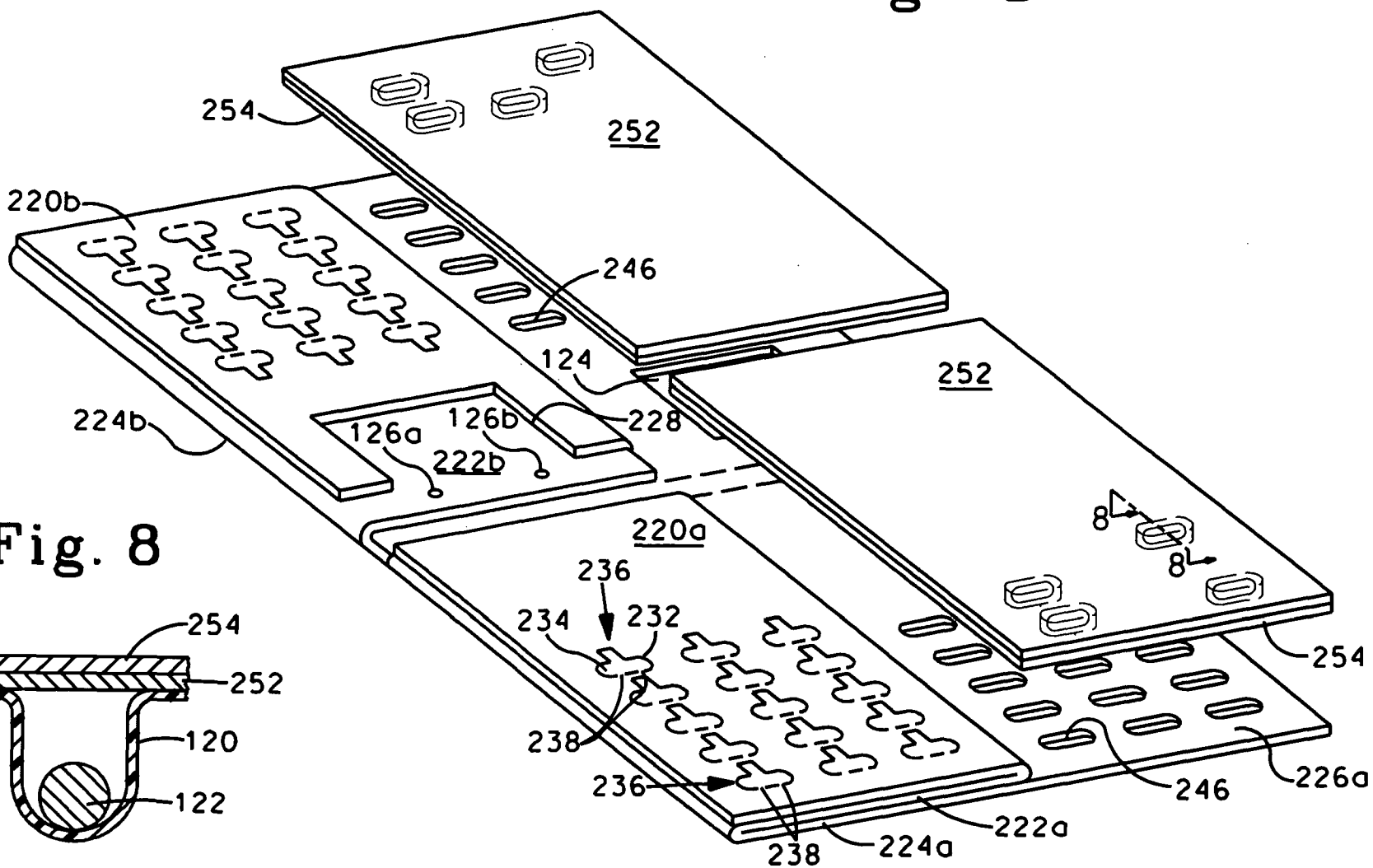
FIG. 7D is an exploded view of the blank shown in FIG. 7A and a pair of blister packs each facing downwardly towards one of the plurality of blister panels.

FIG. 7D illustrates an exploded view of the blank 200 including the circuitry unit 260 and a pair of blister pack 250. With the exception of the circuitry unit 260 which are added to the blank 200, FIG. 7D is exactly the same as FIG. 7A. Therefore, a detailed discussion of incorporating the blister panels 250 onto the blank 200 will be omitted to avoid redundancy.

To construct the blank 200 illustrated in FIG. 7C to form the package assembly 100, the circuit panels 222*a*, 222*b* are folded onto the exterior panels 224*a*, and 224*b* along the Non-continuous score line 216. Next, the contact panels 220*a*, 220*b* are folded onto the circuit panels 222*a*, 222*b* along the Non-continuous score line 214. To enhance the integrity of package assembly 100, adhesive may be applied in certain area of the circuit panels 222*a*, 222*b* which would secure the contact panels 220*a*, 220*b* to the circuit panel and facilitate holding the circuit unit 260 to the circuit panels 222*a*, 222*b*. To ensure that the swing doors 230 are free to pivot, adhesive (anti-stick compound) may be applied on the back side of the contact panels 220*a*, 220*b* so that to prevent the swing doors 230 from sticking to the foil 254 of the blister pack 250. Similarly, adhesive may be applied on the back side of the tear away doors 128 so that to prevent the tear away doors 128 from sticking to the back side of the circuit panels 222*a*, 222*b*. It is preferred that respective circuit panels 222*a*, 222*b* and respective exterior panels 224*a* and 224*b* are heat sealed with one another. Next, the pair of blister pack 250 is fitted into the blister panels 226*a*, 226*b* so that the blister cavities are protruded from the punch out 245, and then the blister panels 226*a*, 226*b* are folded onto the contact panels 220*a*, 220*b* along the Non-continuous score line 218. Then, all the panels 220*a*, 220*b*, 222*a*, 222*b*, 224*a*, 224*b*, 226*a* and 226*b* having heat sealable surfaces are overlaid onto each other to be heat sealed to form the package assembly 100. As noted above, depends on the number of panels to be folded, every permutation of possible folding sequences regarding the panels 220*a*, 220*b*, 222*a*, 222*b*, 224*a*, 224*b*, 226*a* and 226*b* along non-continuous score lines 214, 216, and 218 is considered to be within the scope of this invention.

FIG. 9A is an exploded perspective view of one blister pill 122 having a momentary switch 290 attached thereto in according to a preferred embodiment of the present invention. FIG. 9A is a cut way portion of FIG. 11 for only illustration purposes.

FIG. 9A illustrates the assembly procedure of one of the blister pills 122 in spaced relation to the momentary switch 290. One ordinary skilled in the art would appreciate that the package assembly 100 is constructed in the same manner as illustrated in FIG. 9B. As noted above, the package assembly 100 is constructed from the blank 200, the blister pack 250, and the circuit unit 260 all incorporated with one another. The package assembly 100 includes fifteen blister cavities 120, each blister cavity having a pill 122 housed therein and, of which, one blister incorporated the momentary switch 290 thereto is best depicted in FIG. 9B. The detail operation of the momentary switch 290 is now described. For illustrative purposes, only one blister cavity 120 having a pill 122 therein with a momentary switch 290 attached to the blister cavity 120 is discussed.

Figure 10A:
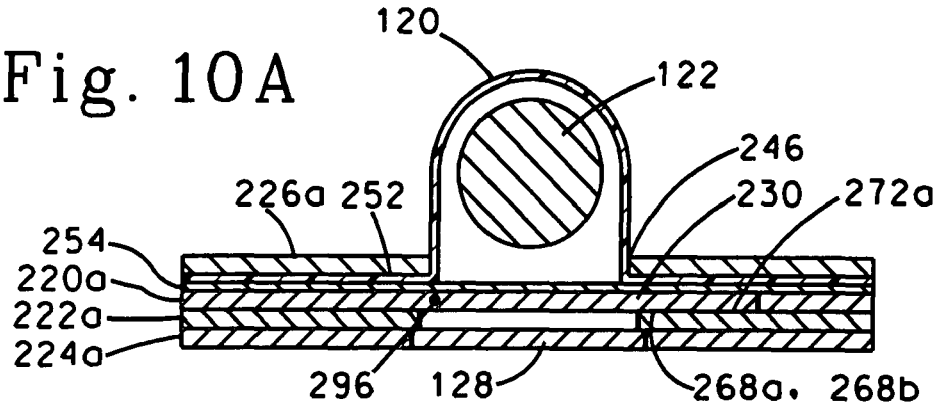
FIG. 10A is a sectional view of FIG. 9B shown along line 10-10 illustrating the momentary switch in an open position.
Figure 10B:
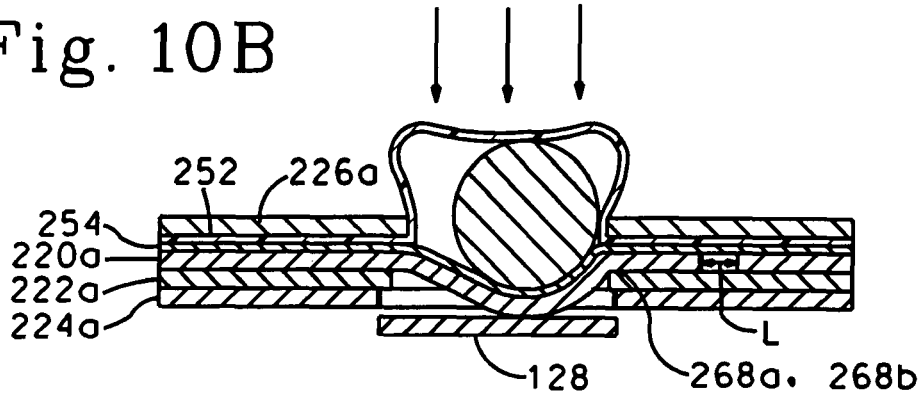
FIG. 10B is the same as FIG. 10A illustrating the pill is causing the momentary switch to be activated and in a closed position.
Figure 10C:
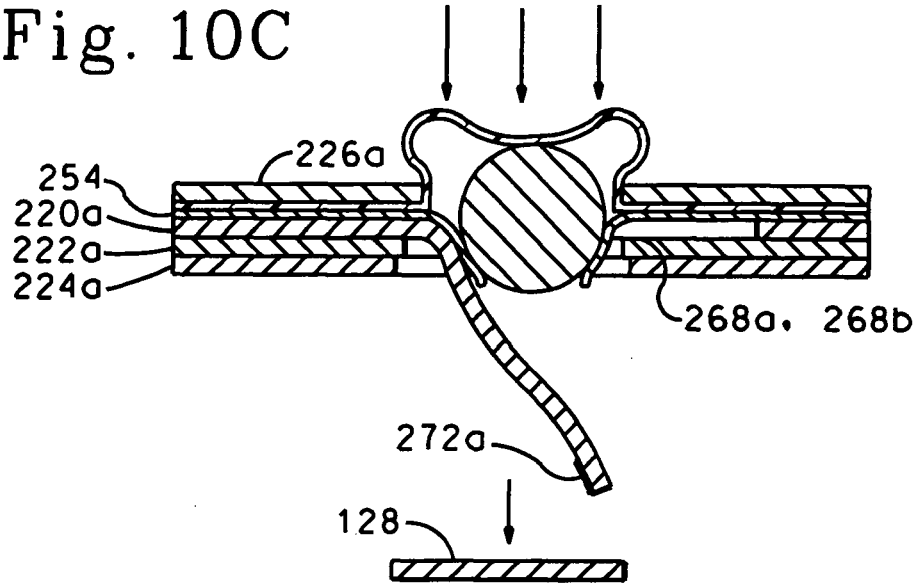
FIG. 10C is the same as FIG. 10B illustrating the pill is dispensing from the assembly package.

FIGS. 10A-10C are cross sectional views taken along line 10-10 of FIG. 9*b*, illustrating the operation of momentary switch 290 in accordance to the preferred embodiment of the invention. FIGS. 10A-10C shows only one blister pill 122 having a momentary switch 290 attached thereto, but one skill in the art appreciates that in the package assembly 100, each blister pill 122 has one momentary switch 290 attached thereto. As noted above, in the preferred embodiment of this invention, the momentary switch 290 is used to monitor the dispensing of pill 122 from the package assembly 100. FIG. 10A shows the momentary switch 290 in an opened position in which the conductive contact surface 272*a* is spaced apart from the contacting surfaces 268*a*, 268*b*. As noted above, the respective contact surfaces 268*a*, 268*b* are symmetric with respect to the contacting surface 272*a* and the contact surfaces 268*a*, 268*b* are in the same plane, thus in the sectional views of 10A-10C, the contact surfaces 268*a*, 268*b* are present. A portion of the blister panel 226 with the blister cavity 120 having the pill 122 therein is protruded from the punch out 246. FIG. 10A clearly shows that the contact panel 220 and the circuit panel 222*a* are laid onto one anther. The contact panel 220 and the circuit panel 222*a* are sandwiched between the blister panel 226 and the exterior panel 224*a*. The tear away door 128 protects the circuit panel 222*a* from possible damage. Since the tear away doors 128 are only used for protection purposes, then the tear away doors 128 are not necessary component of the package assembly 100. As described hereinbefore with reference to FIGS. 3A-3D, the swing door 230 having the substantially rectangular tab 236 pivots with respect to hinge point 296. When the pill 122 is push out of the blister cavity 120; the pills 122 breaks through the foil 252 and push down onto the swing door 230. In response, the swing door 230 pivots downwardly out of plane of panel 220*a* as best illustrated in FIG. 10B. It should be noted that the downward distance of the swing door 230 corresponds to the linear distance (L) in which the tab 236 moved away laterally with respect to the panel 220*a*. As the pill 122 continue to push out of the blister cavity 120, the tab 236 having conductive contacting surface 272*a* would come in contact in a sliding manner with the conductive contact surfaces 268*a*, 268*b* and put the momentary switch 290 in closed position. During the sliding motion of tab 236 over the contact surfaces 268*a*, 268*b* the momentary switch remained in closed positioned. As the pill 122 continue to move out downwardly from the blister cavity 120, the contacting surface 272*a* is disengaged from the contact surfaces 268*a*, 268*b*, which put momentary switch 290 back in the opened position and the tear away door is now separated from the exterior panel 224*a*. It is also possible to remove the tear away door prior to attempting to push the pill 122 out of the package. The pill 122 is dispensed from the blister cavity 120, when the tab 236 is passed through the punch out 240. It should be noted that the width of the contacting surface 272*a* and/or the width of the contact surface 268*a*, 268*b* and the speed at which the pill 122 is pushed out, would control the time the momentary switch 290 is remained in closed position.

Figure 11:
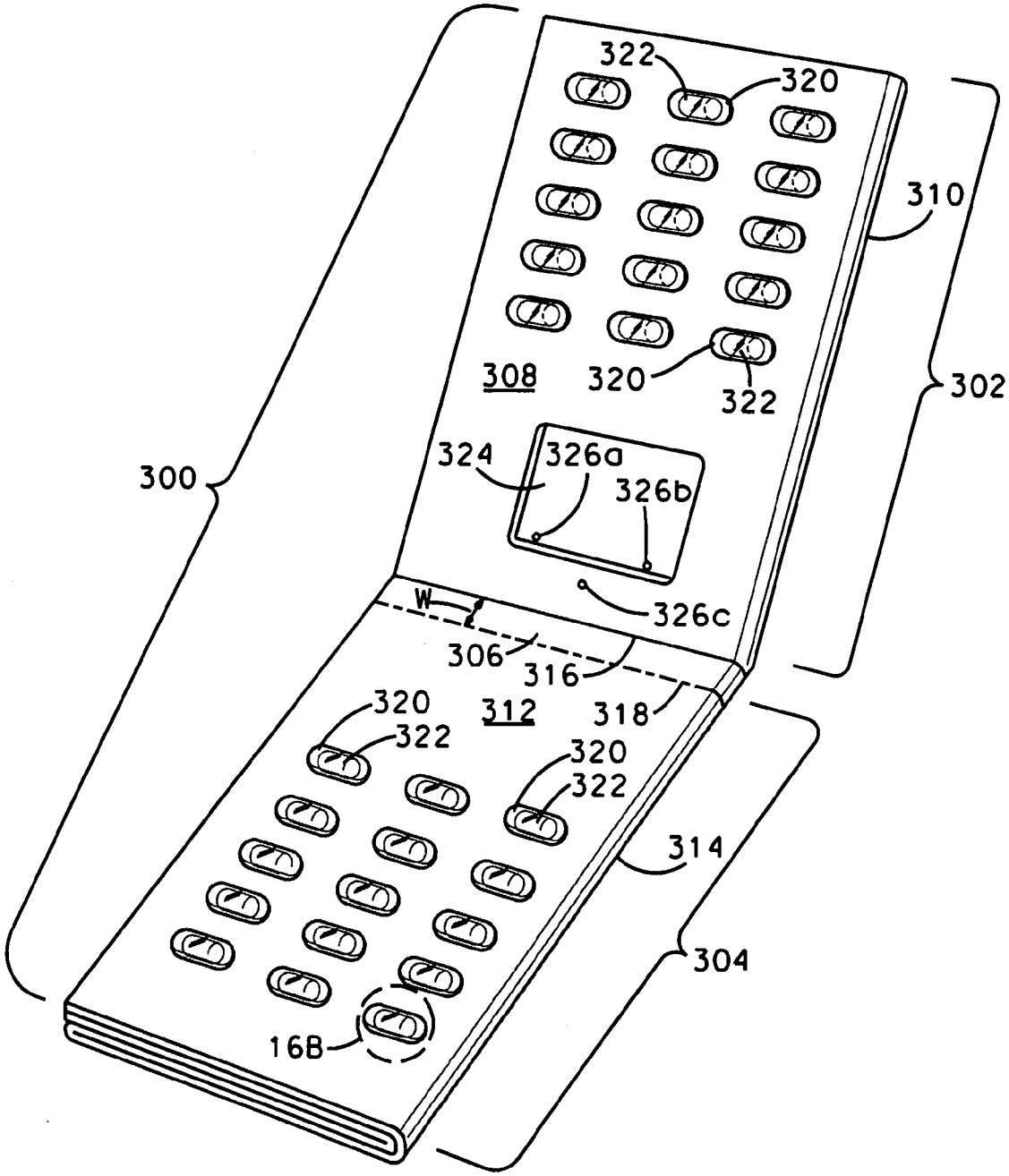
FIG. 11 is a perspective view of a package assembly adapted for use with pharmaceutical articles in accordance with another embodiment of the present invention.

FIG. 11 is a perspective view of a package assembly 300 used generally for pharmaceutical articles in accordance with the second preferred embodiment of the present invention. The pharmaceutical articles used in the package assembly 300 are, for example, capsules, tablets, and/or pills for controlled indication of dispensing of the pharmaceutical articles from the package assembly 300. Although the package assembly 300 is used for storing capsules, tablets, and/or pills, but one of ordinary skill in art would appreciate that the package assembly 300 may be used for variety of other consumer products such as battery, electronic devices and the like.

The package assembly 300 includes a first portion 302 and a second portion 304 which are integrally attached to one another by a ridge 306. The first portion 302 includes a front side 308 and a back side 310. Similarly, the second portion 304 includes a front side 312 and a back side 314. The first portion 302 and a second portion 304 are best understood by reference to FIGS. 13 and 17A-17C, the function and use of which will be described in greater detail hereinafter. The ridge 306 is defined by two substantially parallel non-continuous score lines 316 and 318. The width (W) of the ridge 306 is generally corresponds to the thickness of the first and second portions 302, 304 and will be described in greater detail below. Each of the respective first and second portions 302,304 includes a blister pack 250 (not entirely visible in FIG. 11) having a 2D matrix of blister cavities 320. At least one blister pack 250 is sandwiched between front and back sides 308, 310 in the first portion 302 and at least one blister pack 250 is sandwiched between front and back sides 312, 314 in the second portion 304. Each of the blister cavities 320 is protruded from the respective first side of the first portion 302 and the second portion 304. Each blister cavity receives a pill 322 therein. Opening 324 in the first portion 302 is provided to receive a microprocessor 262 (shown in FIGS. 15A & 15B). The microprocessor 262 in corporation with a momentary switch 490, as described hereinafter, permits the accessing of the pills 322 in each blister cavity 320 to be monitored. Holes 326*a*, 326*b* are also provided to place Light Emitting Diodes (LEDs) 266 that are part of the circuitry unit 260 in the package assembly 300. The holes 326*a*, 326*b* are located on the back side 310 and are exposed through the opening 324 of the front side 324. The first portion 302 and the second portion 304 may also be attached together by any suitable means including, but not limited to, by adhesives or mechanical means. It should be noted that the first portion 302 and the second portion 304 can be separated and used individually without compromising the integrity and the function of the package assembly 300. When the first portion 302 and the second portion 304 are separated, each portion can contain a circuitry unit. Generally, the size of the package assembly 300 depends on the number of pills 322 stored in the package assembly 300. The first portion 302 and the second portion 304 are preferably made of paper, paperboard, or cardboard, but other suitable materials may be used as well. The package assembly 300 is portable, easy to use, inexpensive, and effectively assist a patient in following a prescribed regimen for taking medication.

Figure 12:
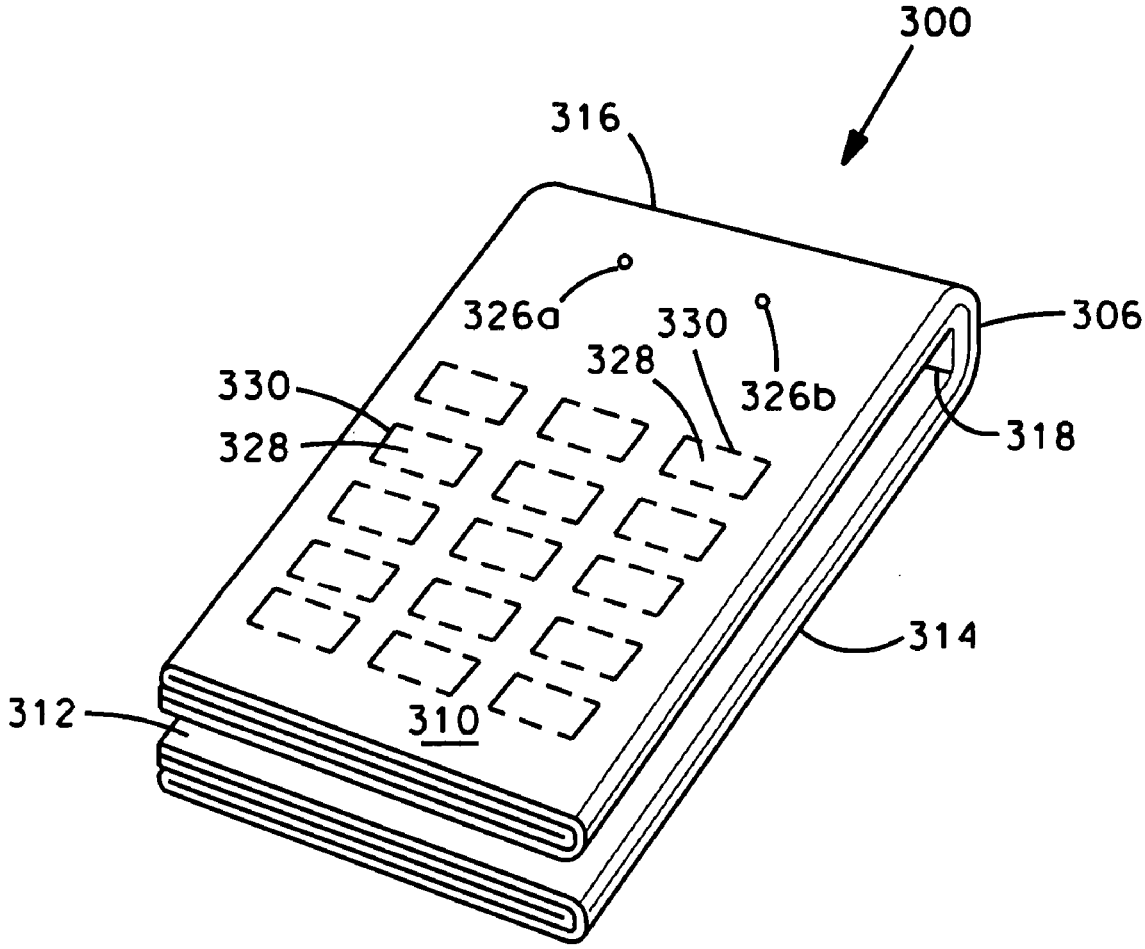
FIG. 12 is a perspective view of the package assembly shown in FIG. 11, illustrating the package assembly in folded position.

FIG. 12 illustrates the package assembly 300 of FIG. 11 which is folded in half. When folded in half, the package assembly 300 resembles a book. As noted above, the width (W) of the ridge 306 is provided to compensate for the thickness of the blister pack 250 and the circuitry unit 460 disposed therein. When the package assembly 300 is in the folded position, the ridge 306 permits the first and second portions 302 and 304 to fold onto one another with ease and prevents possible tearing of non-continuous score lines 316 and 318 in the folded area. As will be appreciated from viewing FIGS. 11 and 12, the back side 310 of the first portion 302 includes a 2D matrix of tear away doors 328 that are each defined by non-continuous score lines 330. The 2D matrix of tear away doors 328 are aligned with the corresponding blister cavities 320 shown in FIG. 11. The function and use of the tear away doors 328 are best understood by reference to FIGS. 17A-17C and will be described in greater detail hereinafter.

Figure 13A:
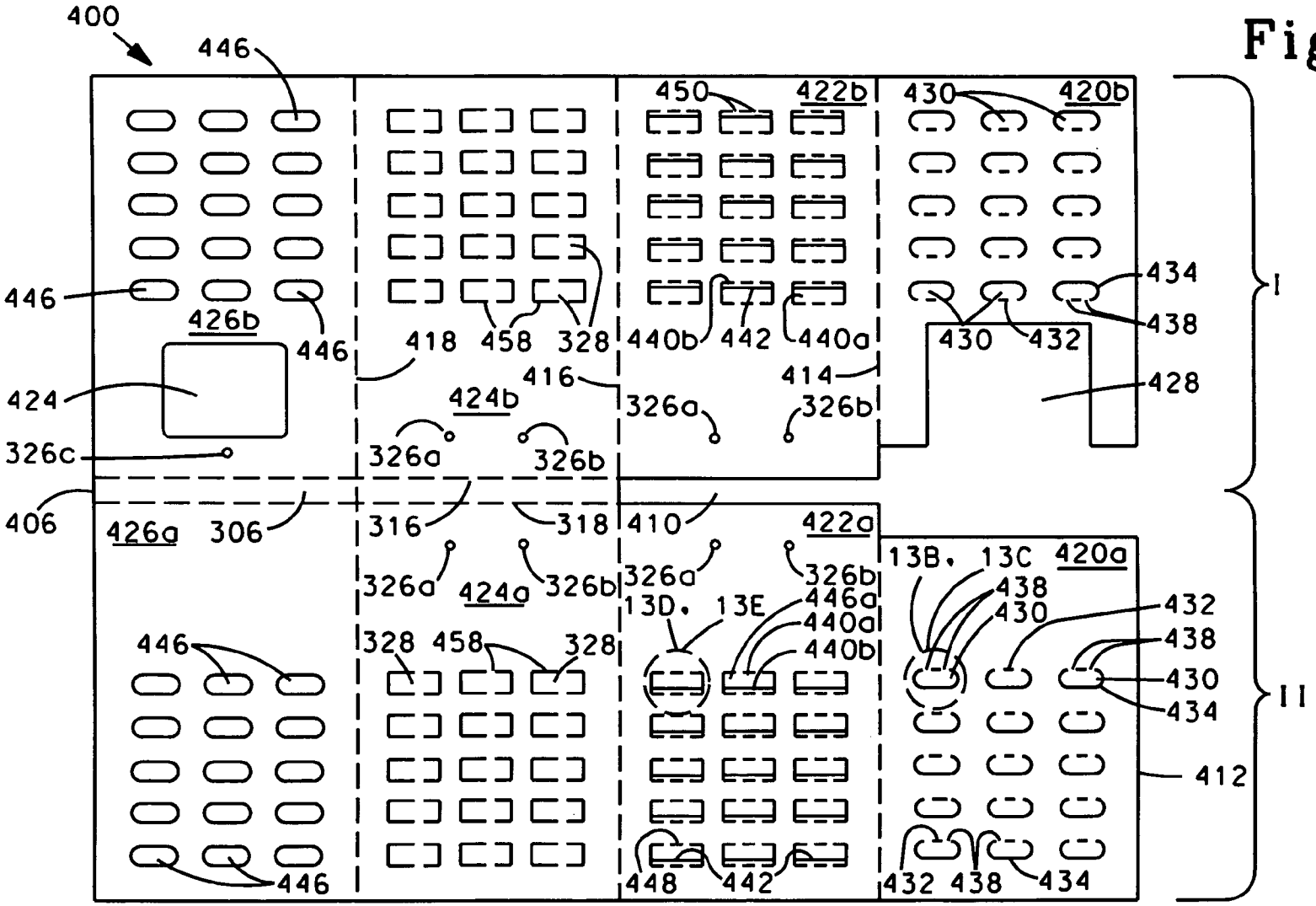
FIG. 13A is a plan view of a blank used to form the package assembly shown in FIG. 11.

FIG. 13A is a plan view of a blank 400 used to form the package assembly 300 of FIG. 11 in accordance with the second preferred embodiment of the present invention. The blank 400 is constructed from any suitable foldable material, such as paperboard that is die-cut to form a generally rectangular configuration when the blank 400 is in the unfolded position. It is well within the scope of this invention to use any suitable material well known or later developed in the art such as, for example, paper, plastic, and the like. The blank 400 is divided into section I and section II by two longitudinal non-continuous score lines 316 and 318 extended along the length of the blank 400. It will be appreciated that the practice of this invention permits the section I and section II be separated from the one another so that each section I or section II can be folded to form a package assembly that would use and function exactly the same manner as the package assembly 300.

In the exemplary embodiment of FIG. 12, when the blank 400 is folded, respective sections I and II are defined by respective first and second portions 402 and 404. The longitudinal non-continuous score lines 402 and 404 are extended from left edge 406 of the blank 400 to the central portion of the blank 400. The non-continuous score lines 316 and 318 are substantially parallel and form the ridge 306, as discussed above. A cut out 410 is formed from the central portion of the blank 400 to the right edge 412 of the blank 400. Transverse non-continuous score lines 414, 416, and 418 extend along the width of the blank 400 and cooperate with the longitudinal non-continuous score lines 416 and 418 to define eight panels, namely, two contact panels 420*a*, 420*b*, two circuit panels 422*a*, 422*b*, two exterior panels 424*a*, 424*b*, and two blister panels 426*a*, 426*b*. The central portion of the blank 400 is defined by intersection of non-continuous score lines 316 and 318 with the transverse non-continuous score line 416. It should be noted that the number of panels illustrated in FIG. 13A is strictly exemplary in nature and is in no way intended to limit the number of panels in the package assembly 300.

The contact panel 420*b* includes a rectangular cut out 428 which extend from one end of the panel 420*b* toward the center thereof. In the exemplary embodiment of FIG. 13A, the contact panel 420*a* may have similar cut out 428 in which the two panels 420*a*, 420*b* would be identical. The blister panel 426*b* includes the opening 424 which cooperates with the cut out 428 to permit the microprocessor 260 to be exposed when the blank 400 is folded to form the package assembly 300 as depicted in FIG. 11. It should be noted that the cut out 428 and the opening 424 are not critical to the practice of the invention. In the absent of the cut out 428 and the opening 424, the circuitry unit 460 is concealed between the panels 420*a*, 420*b*, 422*a*, 422*b*, 424*a*, 424*b*, and 426*a*, 426*b* when the blank 400 is in the folded position.

Each of the contact panels 420*a*, 420*b* includes an 2D matrix of individual swing door 430 that are each defined by non-continuous score lines 432. FIG. 13A illustrates a total of fifteen swing doors 430 that are substantially oblong in shape and are positioned approximately in the center of contact panels 420*a*, 420*b*. It should be noted that the number of swing doors 430 shown in FIG. 13A is strictly exemplary in nature and is in no way intended to limit the number of swing doors 430 that can be included in the package assembly 400. Furthermore, each swing door 430 preferably stands alone and is not connected with another swing door 430.

Figure 13B:
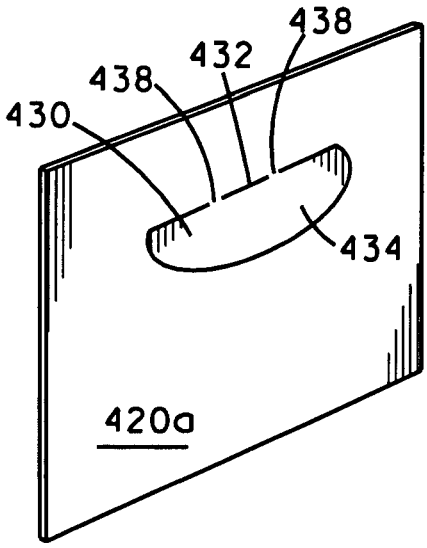
FIG. 13B is a close-up view of a portion of FIG. 13A illustrating an enlarged front view of one swing door.
Figure 13C:
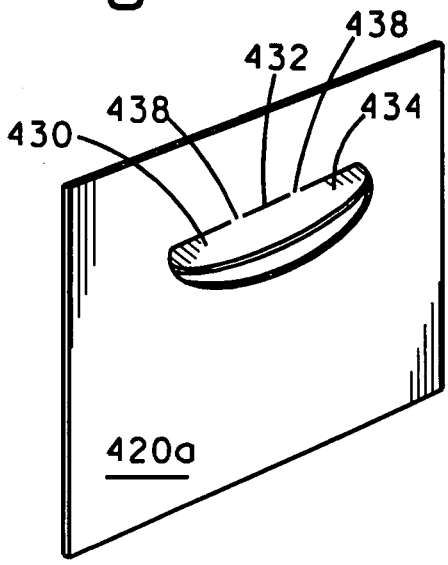
FIG. 13C is a close-up view of a portion of FIG. 13A illustrating the swing door being positioned out of the plane of the contact panel.

For illustrative purposes only, FIGS. 13B, 13C shows only a portion of the contact panel 420*a* which illustrates the manner in which one of the swing doors 430 pivots with respect to the panel 420*a*. The swing door 430 is defined by the non-continuous score-line 432 and includes a frusto-oval portion 434. The non-continuous score line 432 is interrupted by a pair of nicks 438 so as to hold the swing door 430 to the contact panel 420*a* and permits the swing door 430 to pivot in and out of the plane of panel 420*a* as best depicted in FIG. 13C. One of ordinary skills in the art would appreciate that the pair of nicks 438 functions similarly to that of a typical door hinges which permit the swing door 430 to pivot along an axis aligned with a second long side of the generally frusto-oval portion 434.

Figure 13D:
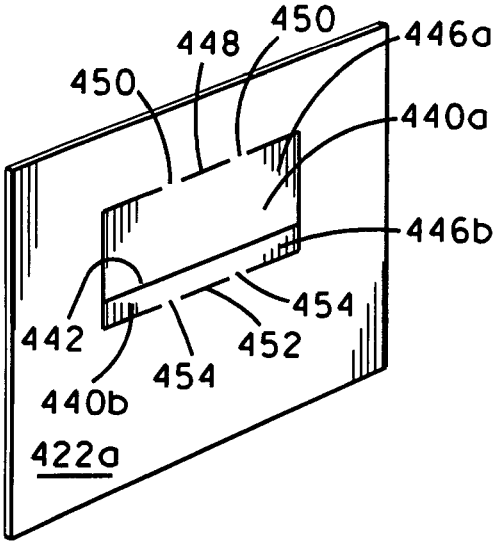
FIG. 13D is a close up view of a portion of FIG. 13A illustrating the swing door being positioned within in a plane of the circuit panel.
Figure 13E:
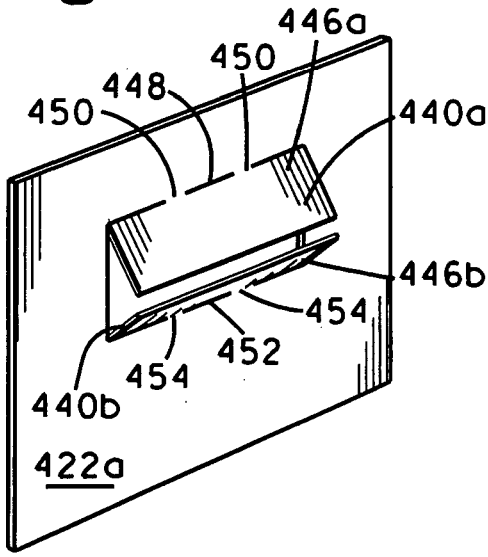
FIG. 13E is a close-up view of a portion of FIG. 13A illustrating the swing door being positioned out of the plane of the circuit panel.

For illustrative purposes only, FIGS. 13D and 13E show only a portion of the circuit panel 422*a* which illustrates the manner in which one of the swing doors 440*a*, 440*b* pivots with respect to the panel 422*a*. The pair of swing doors 440*a*, 440*b* is aligned with the corresponding swing door 430 to be used forming an electronic momentary switch 490 (FIG. 16A) when the blank 400 is in the folded position and the circuitry unit 460 is attached thereto. The function and use of the momentary switch are best understood by reference to FIGS. 17A-17C and will be described in greater detail later.

The swing doors 440*a* and 440*b* are defined by a cut line 442. Each of the swing door 440*a*, 440*b* is defined by a generally rectangular body portion 446*a* and 446*b*. The non-continuous score line 448 is interrupted by a pair of nicks 450 so as to hold the swing door 448 to the contact panel 422*a* and permits the swing door 440*a* to pivot in and out of the plane of panel 422*a* as best depicted in FIG. 13E. Likewise, the non-continuous score line 452 is interrupted by a pair of nicks 454 so as to hold the swing door 440*b* to the contact panel 422*a* and permits the swing door 440*b* to pivot in and out of the plane of panel 422*a*. One of ordinary skills in the art would appreciate that the pair of nicks 450 and 454 functions similarly to typical door hinges which permit the swing doors 440*a*, 440*b* to pivot along an axis aligned with a second long side of the generally rectangular body portion 446*a* and 446*b*. The swing doors 440*a*, 440*b* are positioned approximately in the center of circuit panels 422*a*, 422*b*. It should be noted that the number of swing doors 440*a*, 440*b* shown in FIG. 13A are strictly exemplary in nature and is in no way intended to limit the number of swing doors 440*a*, 440*b* that can be included in the package assembly 400. Furthermore, each swing door 440*a*, 440*b* preferably stands alone and is not connected with another swing door 440*a*, 440*b*. Although the swing door 440*a*, 440*b* are illustrated as being rectangular, it should be noted that it is within the scope of this invention to provide swing door 440*a*, 440*b* of any known shape, such as, for example, but not limited to, square, circular, triangular, trapezoidal, oval, and the like.

Each of the respective exterior panels 424*a*, 424*b* includes a respective 2D matrix of tear away doors 328 that are each defined by non-continuous score lines 458. The exemplary embodiment of FIG. 13A illustrates a total of fifteen tear away doors 328 that are substantially rectangular in shape and disposed approximately in the center of the exterior panels 424*a*. The shape of each tear away door 328 being rectangular is merely exemplary and it is within the scope of this invention to use any known shape to define the tear away doors 328, such as, but not limited to, circular, oval, square, trapezoidal, and the like. The tear away doors 328 are aligned with the respective swing doors 430, 440*a*, and 440*b* in the respective contact panel 420, 420*b*, circuit panels 422*a*, 422*b* when the blank 400 is in the folded position. It should be noted the number of tear away doors 458 illustrated is strictly exemplary in nature and is in no way intended to limit the number of tear away doors 328 that can be included in the assembly package 300. Furthermore, each tear away door 328 stands alone and is not connected with another tear away door 128. The exterior panels 424*a*, 424*b* form the back surface 310 of the package assembly 400 when the contact panels 420*a*, 420*b*, circuit panels 422*a*, 422*b*, and the blister panels 426*a*, 426*b* are folded onto one another. The back side of the package assembly 400 may also be used to print, for example, a doctor's instruction, pharmacists' instructions, graphics, comments and the like.

Each of the blister panels 426*a*, 426*b* includes an 2D matrix of punch outs 446 that correspond to the number of the respective tear away doors 328 in the exterior panels 424*a*, 424*b*, respective swing doors 430, 440*a*, and 440*b* in the respective contact panels 420, 420*b* and circuit panels 422*a*, 422*b* when the blank 400 is in the folded position. The blister panels 426*a*, 426*b* form the front surface 308 of the package assembly 300 (shown in FIGS. 11 and 12) when the contact panels 420*a*, 420*b*, circuit panels 422*a*, 422*b*, and the exterior panels 424*a*, 424*b* are folded onto one another. The 2D matrix of punch outs 446, in the blister panels 426*a*, 426*b*, receives a corresponding 2D matrix of the blister cavity 320 as best depicted in FIGS. 1 and 5. The punch outs 426*a*, 426*b* are positioned approximately in the center of blister panels 426*a*, 426*b*. It should be noted that the number of punch outs 446 shown in FIG. 13A is strictly exemplary in nature and is in no way intended to limit the number of punch outs 446 that can be included in the package assembly 300. Furthermore, each punch outs 446 preferably stands alone and is not connected with another punch out 446. Although the punch outs 446 are illustrated as being oval, it should be noted that it is within the scope of this invention to provide punch outs 446 of any known shape, such as, for example, but not limited to, rectangular, circular, triangular, trapezoidal, square, and the like.

Figure 14A:
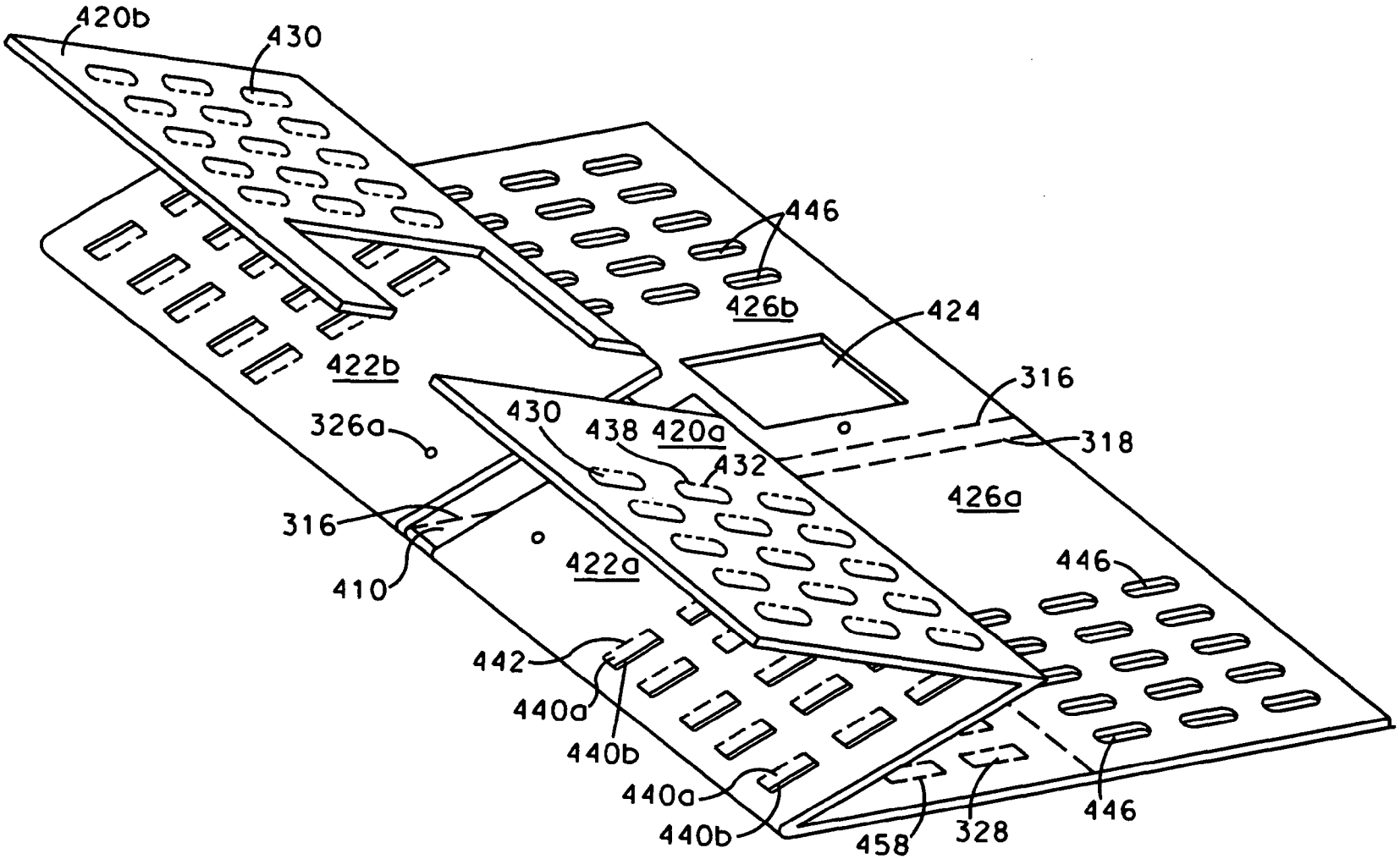
FIG. 14A is a perspective view of the blank in FIG. 13A illustrating the blank in a configuration partially folded.

FIG. 14A illustrates the manner in which the blank 400 of FIG. 13A is folded. Since the number of panels defined by the blank 400 in FIG. 13A is the same as the number of panels defined by the blank 200 in FIG. 3A, then the manner in which the blank 400 is folded to form the assembly package 300, is identical to the blank 200 as described hereinabove with reference to FIGS. 8-10. As such, a detail description of folding of the blank 400 will be omitted to avoid redundancy. In addition, the manner in which the blister pack 250 is disposed in the blister panels 426*a*, 426*b* is identical to that of the blister panel 226*a*, 226*b* described in the first embodiment of the present invention. As such, a detail description of the folding of blank 400 will be omitted to avoid redundancy as well.

Figure 15A:
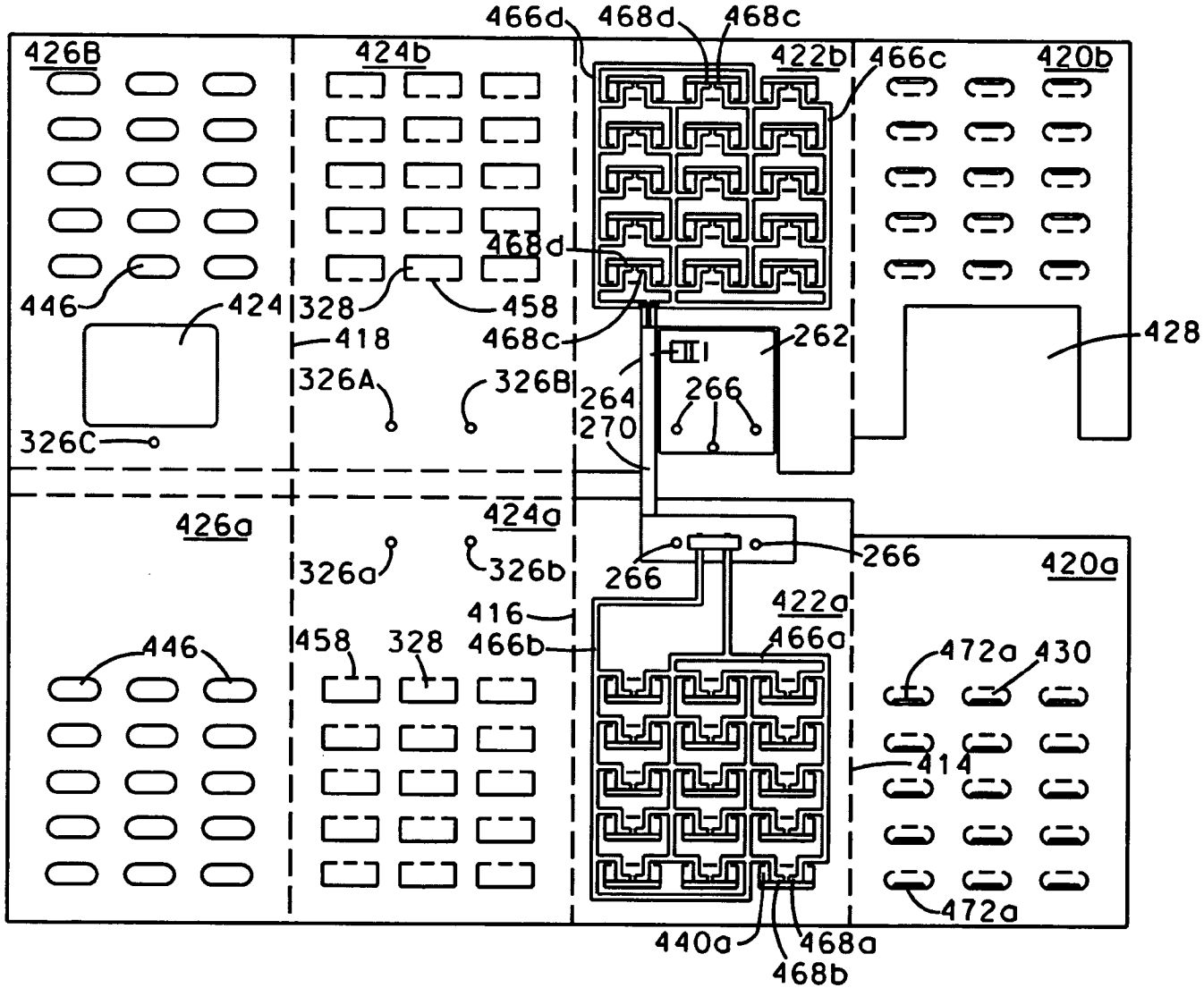
FIG. 15A is a plan view of the blank shown in FIG. 13A, further including a circuitry unit applied to the circuit panels.
Figure 15B:
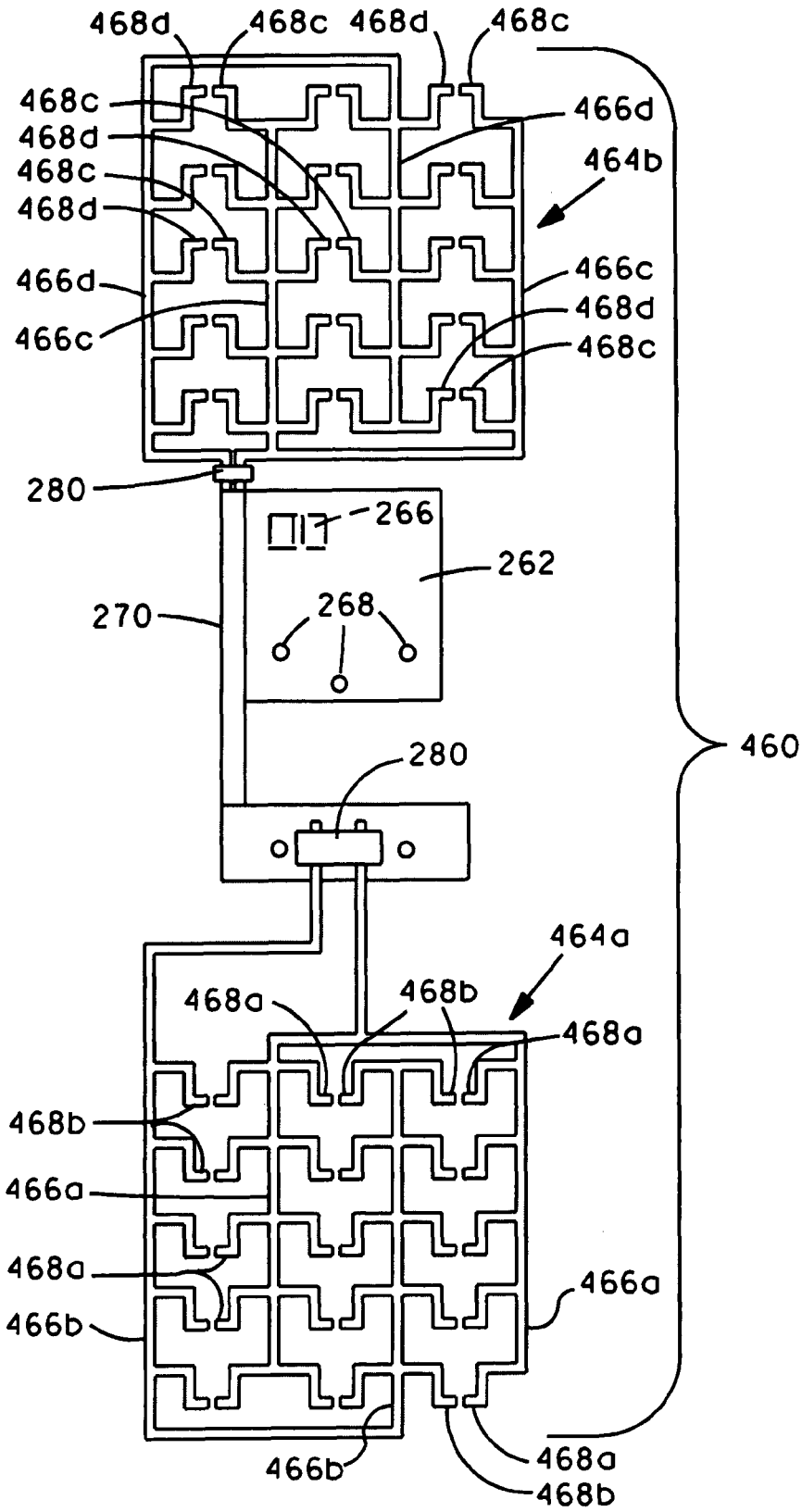
FIG. 15B is a detail view of the circuitry unit shown in FIG. 15A.

FIG. 15A is a plan view of the blank 400 having a circuitry unit 460 disposed therein and is used to form the package assembly 300 in accordance with the second embodiment of the present invention. The circuitry unit 460 is configured on circuit panels 420*a*, 420*b* of the blank 400. As noted above, the circuitry unit 460 in corporation with a momentary switch 490, as described hereinafter, permits the accessing of the patient's pills 122 in each blister cavity 120 to be monitored. As best illustrated in FIG. 15B, the circuitry unit 460 includes the same microprocessor 262 that is used in the preferred embodiment of the present invention with reference to FIGS. 7A and 7B. As such, a detail description of the microprocessor 262 will be omitted to avoid redundancy. The microprocessor 262 may adhesively attached to the circuit panels 422*a*, 422*b*. The microprocessor 262 communicates with the package assembly 300 via conductive circuits 464*a*, 464*b*. Alternatively, one skilled in the art would appreciate that microprocessor 262 may be in optical communication with the package assembly 100 as described hereinafter. The respective conductive circuits 464*a*, 464*b* preferably consists of respective electrically conductive pathways 466*a*, 466*b* and 466*c*, 466*d* that are printed, for example, graphically in the form of printing ink or applied by another method, for example, in the form of foil, onto the circuit panels 422*a* and 422*b* as best depicted in the FIG. 15A.

Each of the conductive pathways 266*a*, 266*b* and 266*c*, 266*d* is configured to form a generally U-pattern conductive pathway. In the exemplary embodiment, the respective U-shaped conductive pathways 466*a*, 466*b* and 466*c*, 466*d* generally are intertwined to minimize the space needed to print the conductive pathways 466*a*, 466*b* and 466*c*, 466*d* on their respective circuit panel 422*a* and 422*b*. The conductive circuits 464*a*, 464*b* functions similarly to that of the conductive circuits used, for example, in parallel switches. It will be appreciated that the parallel pattern configuration of conductive pathways 466*a*, 466*b* and 466*c*, 466*d* are only exemplary and by no means limited to parallel pattern. It is well within the scope of this invention that the conductive pathways 466*a*, 466*b* and 466*c*, 466*d* form other geometrical patterns with one another. Each of the conductive pathways 466*a*, 466*b* includes a plurality of conductive contact surfaces 468*a* and 468*b*. Similarly, each of the conductive pathways 466*c*, 466*d* includes a plurality of conductive contact surfaces 468*c* and 468*d*. In the exemplary embodiment of FIG. 15A, the parallel pattern of the conductive circuits 464*a*, 464*b* correspond to the 2D matrix of the swing door 440*a* in the circuit panels 422*a*, 422*b*. For example, in the circuit panel 422*a*, each swing door 440*a* includes a pair of contact surface 468*a*, 468*b* that are printed on the opposite long side of the rectangular body portion 446*a* with the score line 448. Alternatively, the pair of contact surface 468*a*, 468*b* may be printed on one of the short sides of the swing door 440*a*, provided that the respective conductive contacting surface 472*a*, 472*b* are reconfigured such that the pair of contact surface 468*a*, 468*b* are symmetric with respect to the contacting surfaces 472*a*, 472*b*. For example, if the contact surface 468*a*, 468*b* are printed on one of the short sides of the swing door 440*a*, then the respective conductive contacting surfaces 472*a*, 472*b* are also printed on the short side of the respective swing doors 430. The conductive contact surfaces 468*a*, 468*b* are spaced apart from one another as best shown in FIG. 15B. It should be noted that all of the contact surfaces 468*a*, are branched out from the conductive pathway 466*a* and the entire contact surface 468*b*, are branched out from the conductive pathway 466*b*. Similarly, in the circuit panel 422*b*, each swing door 440*a* includes a pair of contact surface 468*c*, 468*d* that are printed on the opposite long side of the rectangular body portion 446*a* with score line 448. The contact surfaces 468*c*, 468*d* are spaced apart from one another as best shown in FIG. 15B. It should be noted that all the contact surface 468*c* are branched out from the conductive pathway 466*c* and the entire conductive contact surface 468*d* are branched out from the conductive pathway 466*d*. It should be noted that the parallel configuration of conductive pathways 466*a*, 466*b* and 466*c*, 466*d* substantially reduces the number of the electrical contacts needed to communicate with the microprocessor 262.

The conductive paths 466*a*, 466*b* are connected to the microprocessor 262 via the flexible circuit 270. As noted above, the microprocessor 262 including the flexible circuit 270 is the same for both of the embodiments of the present invention. The flexible circuit 270 is connected to the conducting pathways 466*a*, 466*b* and 466*c*, 466*d* by the Z directional electrically conductive tape 280. The Z directional electrically conductive tape 280 is similar to a two sided tape that conducts electricity only up and down through its thickness "z-direction" as well known in the art. The Z directional conductive tape 280 does not conduct across the surface of the circuit panels 222*a*, 222*b*. Advantageously, the Z directional conductive tape 280 could be applied over two conductive traces that are next to each other without connecting them to each other or "shorting them out". One ordinary skilled in the art would appreciate that a Z directional conductive adhesive may be used for the practice of the present invention. The Z directional conductive tape 280 is also known as anisotropic electrically conductive tape. Alternatively, It should be noted that a standard conductive adhesive may be applied over two conductive traces that are next to each other, however, one of ordinary skilled in the art would know that the standard conductive adhesive have to be applied in a manner that a small amount is applied to each conductive trace so it would not spread out and touch the other contact surfaces 468*a*, 468*b* and 468*c*, 468*d*.

The microprocessor 262 is programmed to keep track of the time to take the pill and alert the patient if the pill was not taken at the appropriate time. The microprocessor 262 may be programmed to establish a desired pill schedule and to store in the memory the actual dispensing times of the pills. The audible piezo-alarm 264 sounds to indicate to the patient that it is time to take the pill according to the programmed pill schedule. The microprocessor 262 may be programmed to alert the patient to administer a pill every fixed time interval. The microprocessor 262 may also be programmed to keep track of the untaken pills by the patient. The light emitting diode (LED) 266 is a semiconductor that emits light when eclectically energized. The light emitting diode (LED) 266 acts as tiny light bulb and used as a small indicator light to alert a patient.

The swing doors 430 on the respective contact panels 420*a*, 420*b* receive respective conductive contacting surface 472*a*, 472*b*. As described above, each swing door 430 is defined by the non-continuous score line 432 and includes a frusto-oval portion 434. The conductive contacting surface 472*a* is applied at the tip of the frusto-oval portion 434 opposite from the score line 432. Similarly, the conductive contacting surface 472*b* is applied at the tip of the frusto-oval portion 434 opposite from the score line 432.

The respective conductive contacting surfaces 472*a*, 472*b* are in electrical communication with the respective conductive contact surfaces 468*a*, 468*b* and 468*c*, 468*d*, when the tip of the frusto-oval portion 434 slide over the conductive contact surfaces 468*a*, 468*b* and 468*c*, 468*d*.

Figure 15C:
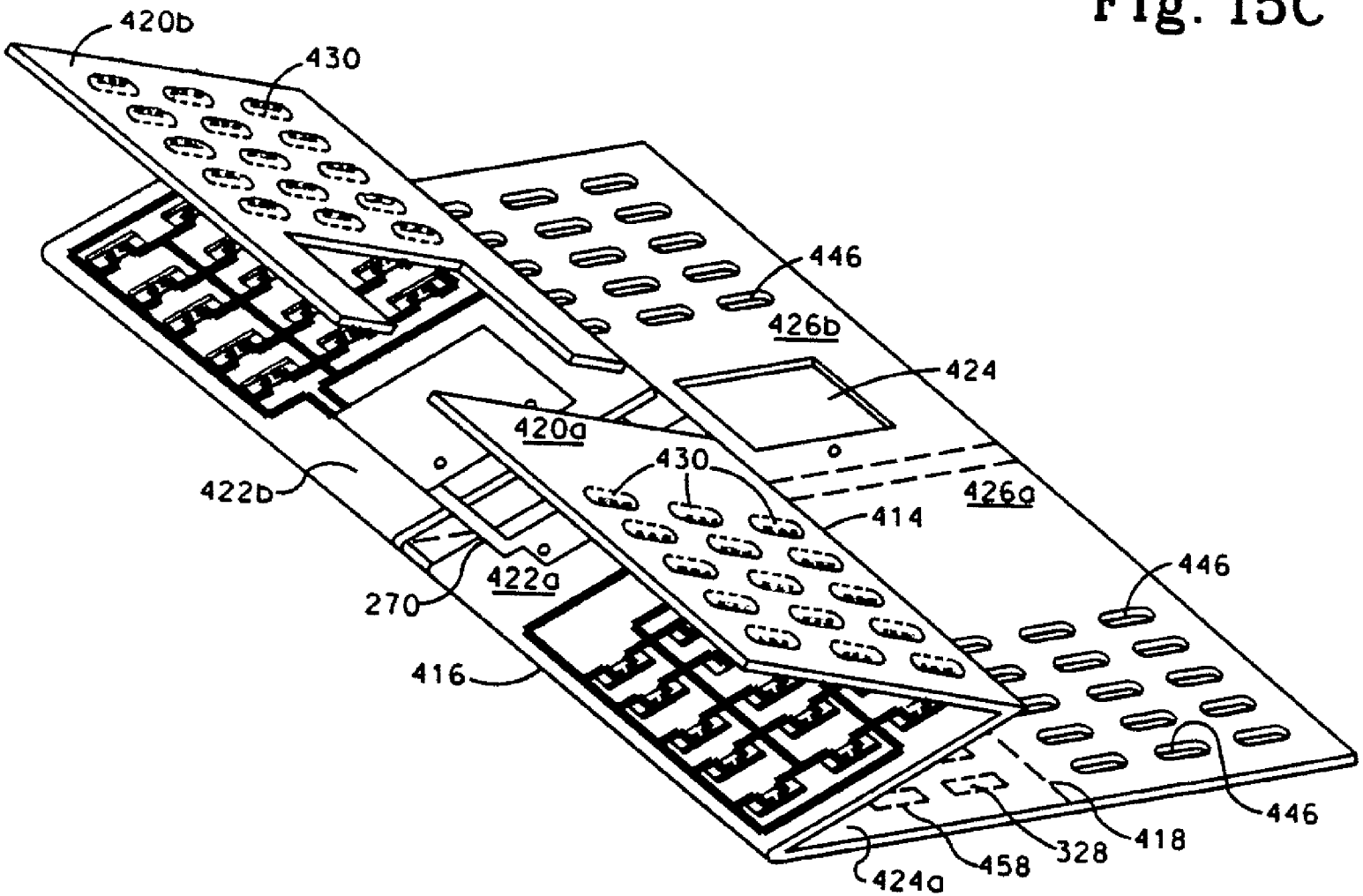
FIG. 15C is a perspective view of the blank in FIG. 15A illustrating the blank in a configuration partially folded.

FIG. 15C illustrates the manner in which the blank 400 of FIG. 15A is folded. The blank 400 in FIG. 15A is folded exactly in the same manner as the exemplary embodiment described above with regards to FIG. 14A. With the exception of the circuitry unit 460 in circuit panels 422*a*, 422*b* and the conductive contacting surfaces 472*a*, 472*b* in the contact panels 420*a*, 420*b* which are added to the blank 400 of FIG. 15A, the two exterior panels 424*a*, 424*b*, and two blister panels 426*a*, 426*b* in FIG. 15A are identical to that of FIG. 13A. As such, a detailed discussion of these panels will be omitted to avoid redundancy. It should be noted that in the FIG. 15A, when the contact panels 420*a*, 420*b* overlay the circuit panels 422*a*, 422*b*, each of the respective swing doors 430 in cooperation with each of the swing doors 440*a* forms a momentary switch 490 that is in an open position. The function and use of the momentary switch 490 are best understood by reference to Figure A-C and will be described in greater detail later.

Figure 14B:
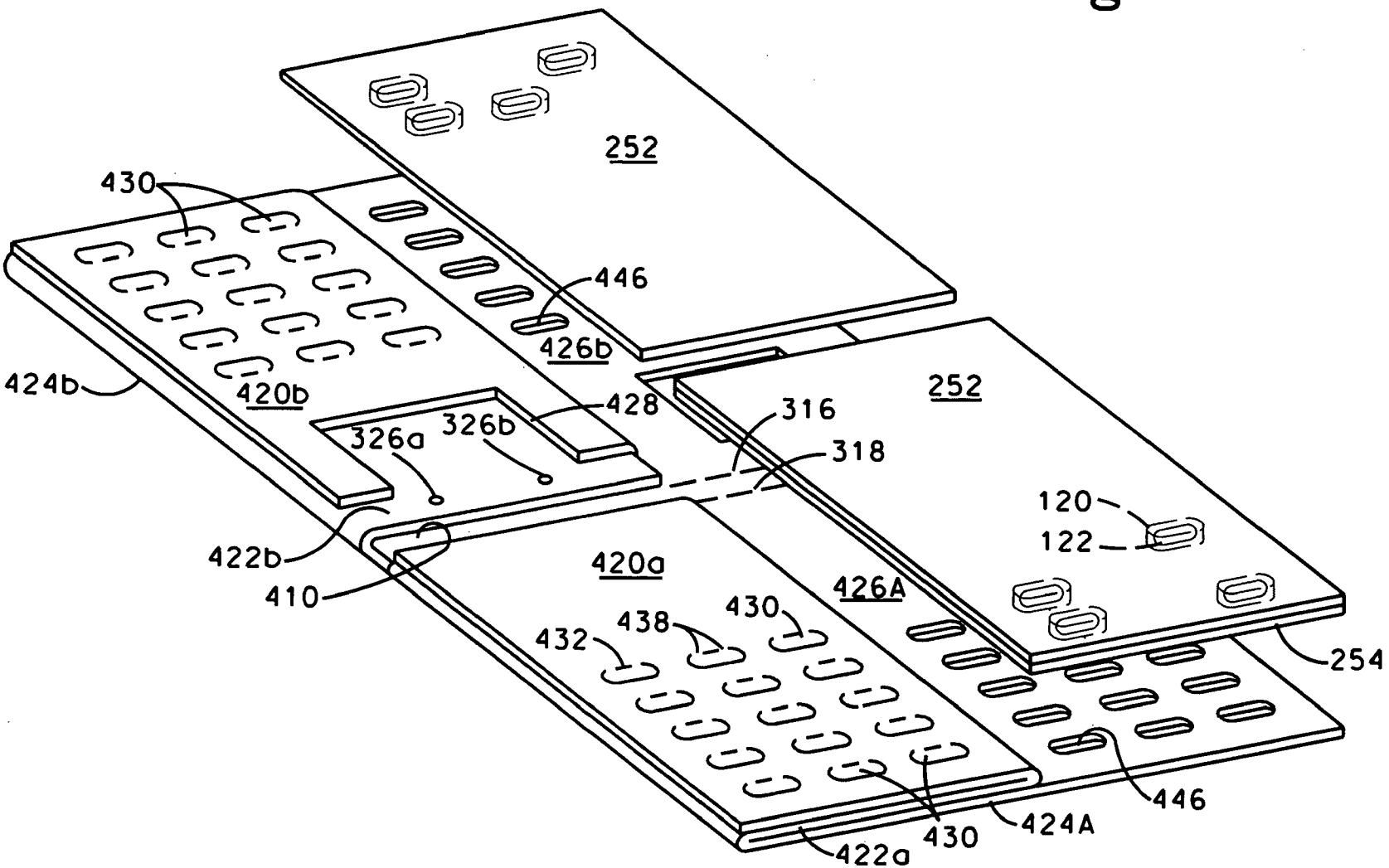
FIG. 14B is similar to FIG. 14A illustrating circuit and contact panels each being folded onto one of plurality of exterior panels and a pair of blister packs each facing downwardly towards one of the plurality of blister panels.
Figure 15D:
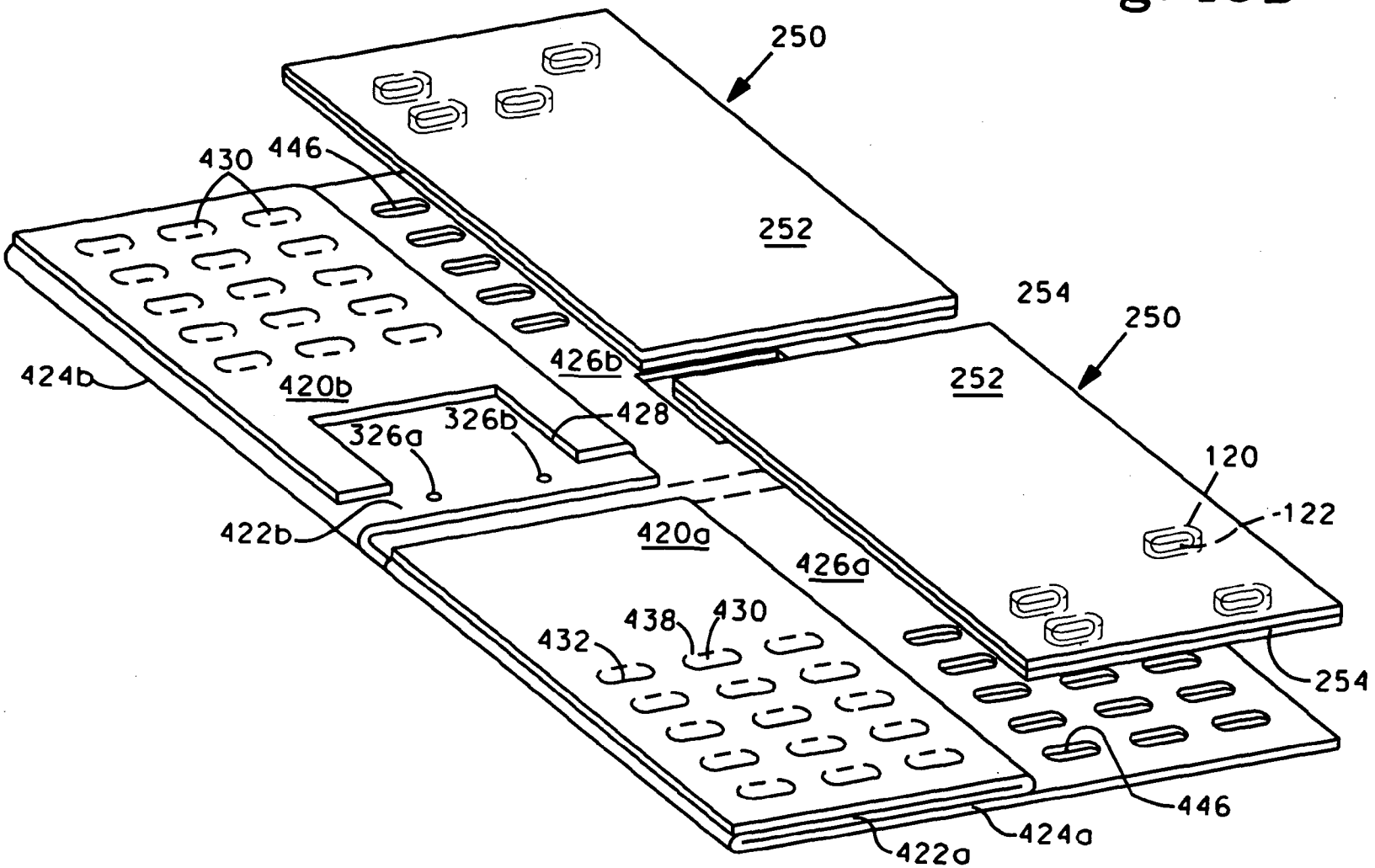
FIG. 15D is an exploded view of the blank shown in FIG. 15A and a pair of blister packs each facing downwardly towards one of the plurality of blister panels.

FIG. 15D illustrates an exploded view of the blank 400 including the circuitry unit 460 and a pair of blister pack 250. With the exception of the circuitry unit 460 which are added to the blank 400, FIG. 15D is exactly the same as FIG. 14B. Therefore, a detailed discussion of incorporating the blister panels 250 onto the blank 400 will be omitted to avoid redundancy.

To construct the blank 400 illustrated in FIG. 15A to form the package assembly 300, the circuit panels 422*a*, 422*b* are folded onto the exterior panels 424*a*, and 424*b* along the Non-continuous score line 216. Next, the contact panels 420*a*, 420*b* are folded onto the circuit panels 422*a*, 422*b* along the Non-continuous score line 414. To enhance the integrity of package assembly 300, adhesive may be applied in certain area of the circuit panels 422*a*, 422*b* which would secure the contact panels 420*a*, 420*b* to the circuit panel and facilitate holding the circuit unit 460 to the circuit panels 422*a*, 422*b*. To ensure that the swing doors 430 are free to pivot, adhesive (anti-stick compound) may be applied on the back side of the contact panels 420*a*, 420*b* so that to prevent the swing doors 430 from sticking to the foil 254 of the blister pack 250. Similarly, adhesive may be applied on the back side of the tear away doors 428 so that to prevent the tear away doors 428 from sticking to the back side of the circuit panels 422*a*, 422*b*. It is preferred that respective circuit panels 422*a*, 422*b* and respective exterior panels 424*a* and 424*b* are heat sealed with one another. Next, the pair of blister pack 250 is fitted into the blister panels 426*a*, 426*b* so that the blister cavities are protruded from the punch out 446, and then the blister panels 426*a*, 426*b* are folded onto the contact panels 420*a*, 420*b* along the Non-continuous score line 418. Then, all the panels 420*a*, 420*b*, 422*a*, 422*b*, 424*a*, 424*b*, 426*a* and 426*b* having heat sealable surfaces are overlaid onto each other to be heat sealed to form the package assembly 300. As noted above, depends on the number of panels to be folded, every permutation of possible folding sequences regarding the panels 420*a*, 420*b*, 422*a*, 422*b*, 424*a*, 424*b*, 426*a* and 426*b* along non-continuous score lines 414, 416, and 418 is considered to be within the scope of this invention.

Figure 16A:
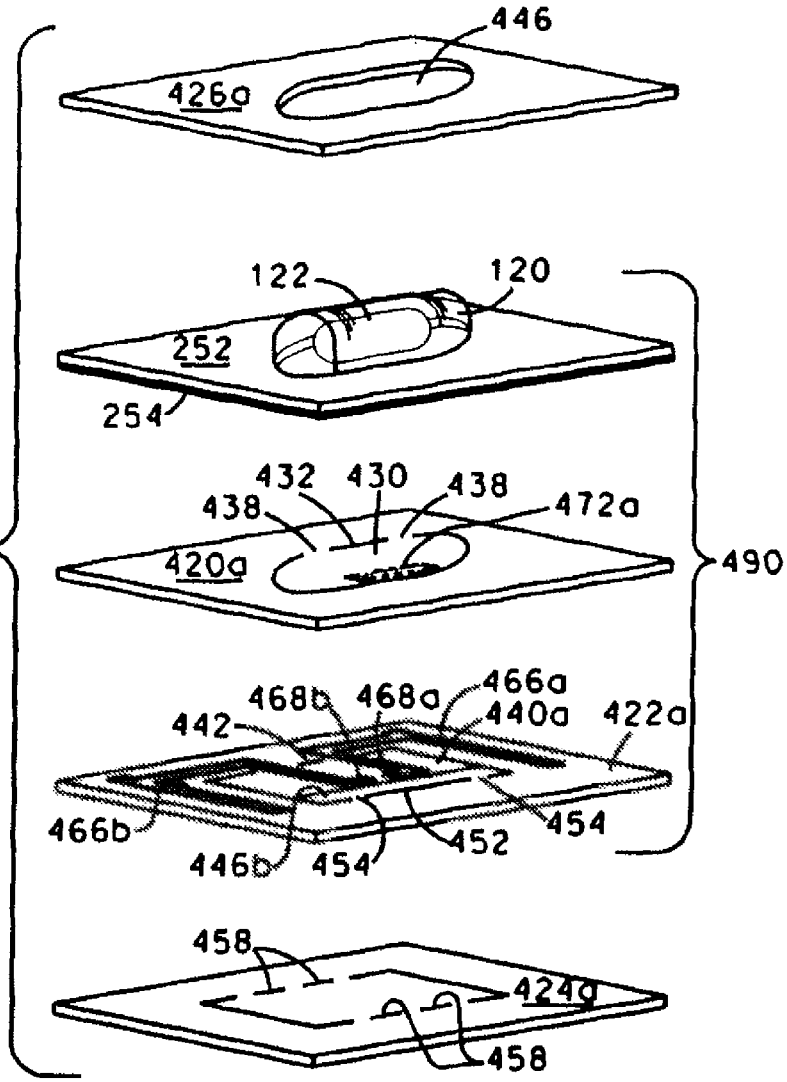
FIG. 16A is an exploded perspective view of one blister pill unit of the package assembly in FIG. 11.
Figure 16B:
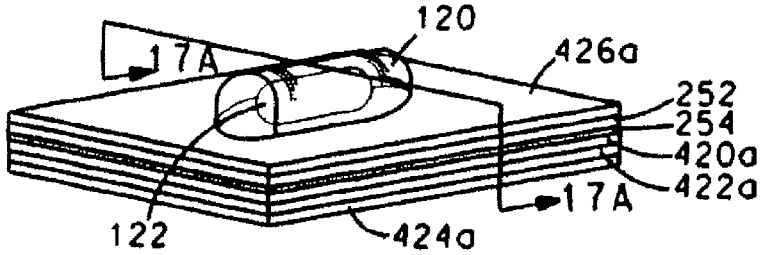
FIG. 16B is a partial perspective view of the blister pill unit shown in FIG. 16A.

FIG. 16A is an exploded perspective view of one blister pill having a momentary switch 490 attached thereto in accordance to a preferred embodiment of the present invention. FIG. 16A illustrates the assembly procedure of one of the blister pills in spaced relation to the momentary switch 490. In the momentary switch 490, swing door 430 having the contacting surface 472*a* thereon is positioned in space relation to the swing doors 446*a*, 446*b*. It should be noted that the contacting surface 472*a* is protected by the swing door 440*b* when the swing door 430 is in contact with the swing doors 446*a*. The swing door 440*b* prevents accidental electrical shorting between the contacting surface 472*a* and the contact surfaces 468*a*, 468*b*. One of ordinary skilled in the art would appreciate that the package assembly 300 is constructed in the same manner as illustrated in FIG. 11. As noted above, the package assembly 300 is constructed from the blank 400, the blister pack 250, and the circuit unit 460 all incorporated with one another. The package assembly 300 includes fifteen blister cavities 120, each blister cavity having a pill 122 housed therein and, of which, one blister incorporated the momentary switch 290 thereto is best depicted in FIG. 16B. The detail operation of the momentary switch 490 is now described. For illustrative purposes, only one blister cavity 120 having a pill 122 therein with a momentary switch 290 attached to the blister cavity 120 is discussed.

Figure 17A:
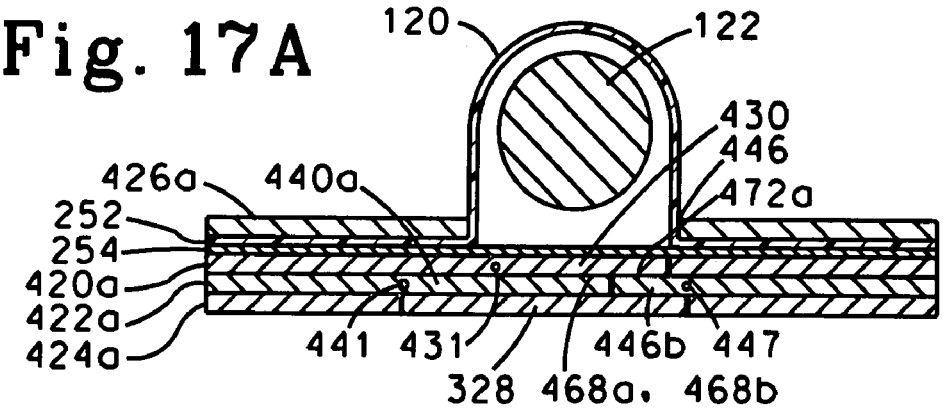
FIG. 17A is a sectional view of FIG. 16B shown along line 17-17 illustrating the momentary switch in an open position.
Figure 17B:
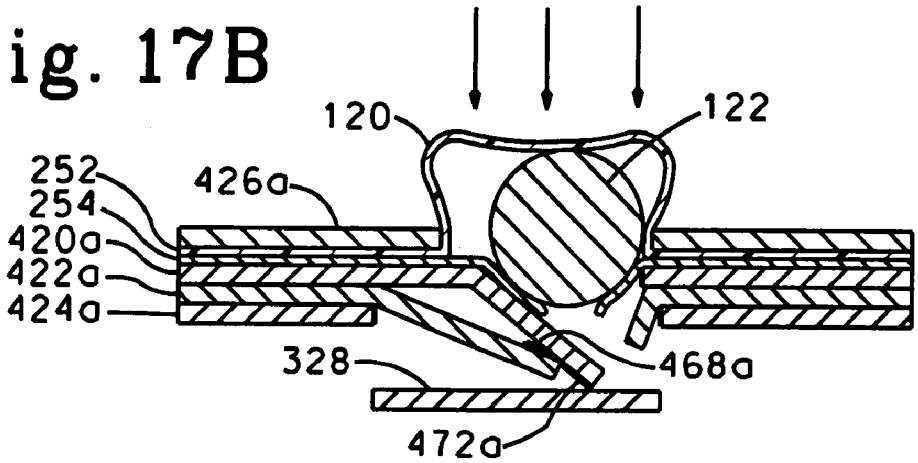
FIG. 17B is the same as FIG. 17A illustrating the pill is causing the momentary switch to be activated and in a closed position.
Figure 17C:
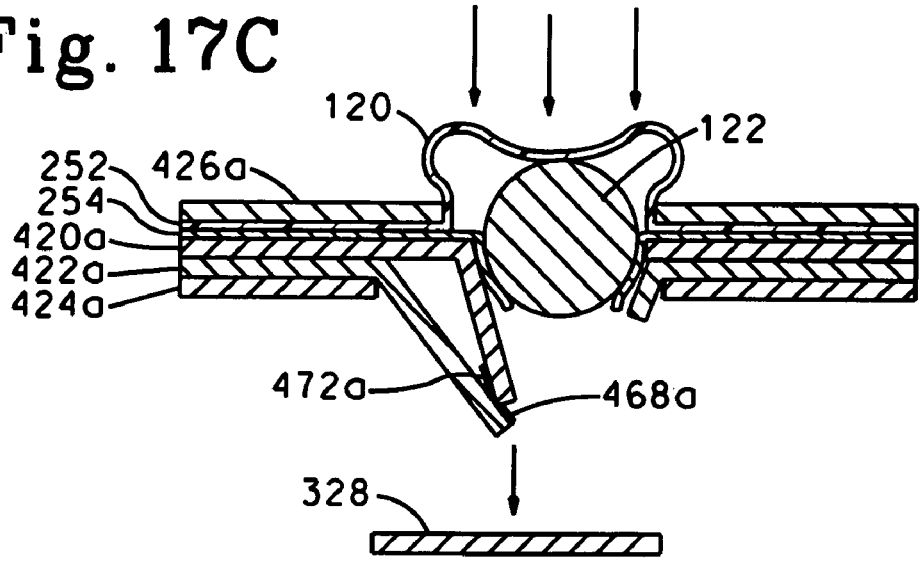
FIG. 17C is the same as FIG. 10B illustrating the pill is dispensing from the assembly package.

FIGS. 17A-17C are cross sectional views taken along line 17-17 of FIG. 16B, illustrating the operation of momentary switch 490 in accordance with the second embodiment of the invention. FIGS. 17A-17C shows only one blister pill having a momentary switch 490 attached thereto, but one skill in the art appreciates that in the package assembly 300, each blister pill has one momentary switch 490 attached thereto. As noted above, the momentary switch 490 is used to monitor the dispensing of pill 122 from the package assembly 300. FIG. 17A shows the momentary switch 290 in an opened position in which the conductive contact surface 472*a* is spaced apart from the contacting surfaces 468*a*, 468*b*. It should be noted that the respective contact surfaces 468*a*, 468*b* are symmetric with respect to the contacting surface 472*a* and the contact surfaces 468*a*, 468*b* are in the same plane, thus in the sectional views of 17A-17C, the contact surfaces 468*a*, 468*b* are present. A portion of the blister panel 426*a* with the blister cavity 120 having the pill 122 therein is protruded from the punch out 446. FIG. 17A clearly shows that the contact panel 420*a* and the circuit panel 422*a* are laid onto one anther. The contact panel 420 and the circuit panel 422*a* are sandwiched between the blister panel 426*a* and the exterior panel 424*a*. The tear away door 328 protects the circuit panel 422*a* from possible damage. Since the tear away doors 328 are only used for protection purposes, then the tear away doors 328 are not necessary component of the package assembly 300. With particular reference to FIG. 17A, each of the respective swing doors 430, 440*a*, 440*b* pivots with respect to three respective hinges 431, 441, and 447. The basic mechanism of the momentary switch 490 relies on the principle that if two doors are placed together in parallel manner with their hinge points at different locations, the point at which one door contact the other door, will change as one door is pushed against the other door to be opened. Alternately, the momentary switch 490 may have four doors instead of two doors that just described.

With reference to FIGS. 17A-17C, when a user presses on the blister cavity 120, the pill 122 is push out and breaks through the foil 252, which in turn, push down on the swing door 430. The swing door 430 in turn, pivots with respect to the hinge point 431 downwardly out of plane of panel 420*a* as best illustrated in FIG. 17B. It should be noted that the swing door 430 also push out on the swing door 440*b*, which in turn, pivots with respect to hinge point 447. As the pill 122 continue to push out of the blister cavity the swing door 430 also push out the swing door 440*a*, which in turn pivots with respect to hinge point 441. As the pill 122 continue to push out of the blister cavity 120, the tip of the swing door 430 having conductive contacting surface 472*a* would come in contact in a sliding manner with the conductive contact surfaces 468*a*, 468*b* and put the momentary switch 490 in closed position. The tear away door 328 is now separated from the exterior panel 424*a*. It is also possible to remove the tear away door prior to attempting to push the pill 122 out of the package. As noted above, the respective contact surfaces 468*a*, 468*b* are symmetric with respect to the contacting surface 472*a* and the contacting surfaces 268*a*, 268*b* are in the same plane, thus in the sectional views of 17A-17C, the contacting surfaces 468*a*, 468*b* are present. During the sliding motion of the tip of the swing door 430 over the contact surfaces 468*a*, 468*b* the momentary switch 490 remained in closed positioned. When the momentary switch 490 is in the closed position, the tip swing door 430 may or may not be completely positioned behind the swing door 422*a* as best shown in FIG. 17C. As the pill 122 continue to move out downwardly from the blister cavity 120 and is dispensed, swing doors 430 and 440*a* move back towards their original positions and the contacting surface 472*a* is disengaged from the contact surfaces 468*a*, 468*b*, which put momentary switch 490 back in the opened position. It should be noted that the width of the contacting surface 472*a* and/or the width of the contact surface 468*a*, 468*b* and the speed at which the pill 122 is pushed out, would control the time the momentary switch 290 is remained in closed position.

Figure 18:
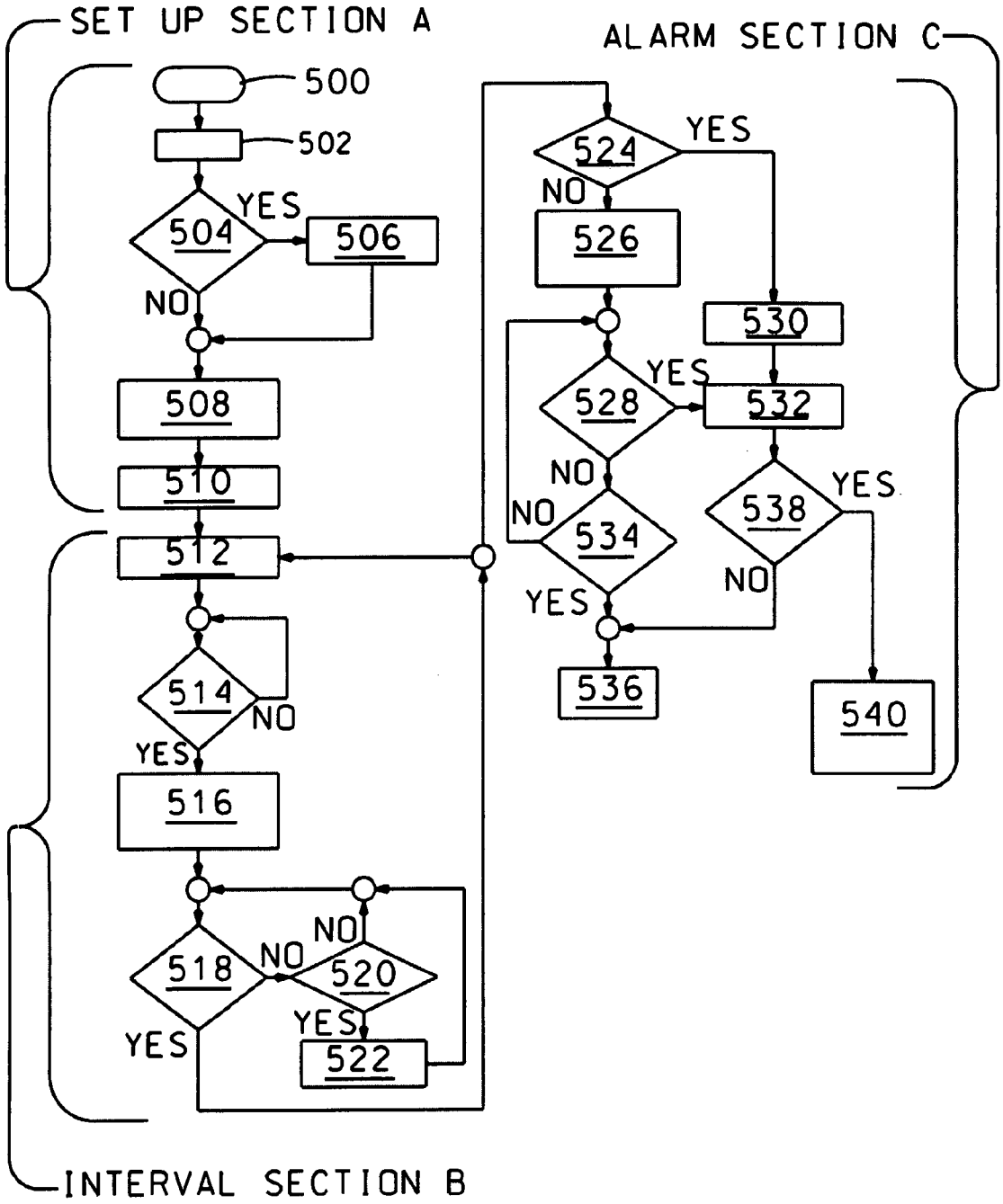
FIG. 18 is flow chart illustrating the operation of the momentary switch having a microprocessor in accordance to the embodiments of the present invention.

FIG. 18 is a flow chart illustrating the operation of a logic control used in the microprocessor 262 in accordance with the preferred embodiment of the invention. The flow chart is organized into three sections: Setup—Section A, Interval time—Section B and Alarm Section—C.

The Setup Section A (steps 500-510), as described below, encompasses the initiating and programming of the central processing unit (CPU) when the package assembly 100 or 300 is assembled. In step 502, the central processing unit (CPU) is initially setup when power is applied in the step 500. After initial setup, a factory test routine can be run, if desired, (steps 504 and 506) to check proper function of the microprocessor 262. In step 508, the parameters that will control the operation of the patient reminder program such as: Dose Interval, Pre-Alarm Interval, Alarms Post-Alarm Intervals are read and initialized into the program. This may be done by interrogation of a set of jumper connections on the circuit unit 260. These jumper connections can be selectively score during assembly of the package and correspond to a predetermined program code stored in the memory of circuit unit 260. After the above four steps, step 510 is run to setup the microprocessor 262 to be ready to sense a pill 122 being expelled from the package assembly 100 or 300. The program is now ready to enter the Interval Section B.

The Interval Section B (steps 512-522) encompass the start of the Dose Interval timing cycle and the sensing of the expulsion of a pill 122 prior to a reminder alarm being sounded. When the first pill 122 is expelled, the circuit receives a signal from the closing of one of the switches (290 or 490) associated with one of the pills 122 and this process is directed to the start of the timing cycle and the manner in which the reminder alarm operates and preempted or silenced by the dispensing of pill 122.

After the first pill is expelled in step 512, the microprocessor 262 receives a signal or sensed by the momentary switch associated with a pill 122 and the Dose Interval timer (step 514) is started. This begins the cycle of alarm times that will continue through all the pills 122 that are scheduled to be taken. At the end of the Dose Interval in step 514, a window of time, referred to as the Pre-Alarm Interval, will be opened in the step 516. During this window of time, in the steps 518, 520, the microprocessor 262 will check to see if a pill 122 has been dispensed by looking for a closure of a momentary switch associated with a pill 122. If the circuit senses a pill dispensed, then in step 522, a Pre-Alarm Flag is set. This flag will be used later as an indication that the pill was taken before the alarm was sounded so the alarm will be preempted. (The Dose Interval time combined with the Pre-Alarm Interval time is equal to the total time between doses.) When the Pre-alarm Interval is completed after step 518, the Dose Interval (step 512) and the program will also proceed to the Alarm Section C.

The Alarm Section C controls—when and if—the alarm will sound and how often it will be repeated if a pill is not expelled after each alarm. The first portion step 524 will check to see if the Pre-Alarm Flag from step 522 has been set.

If the flag has been set (meaning a pill was expelled during the Pre-Alarm Interval) the steps will bypassed the Alarm steps 526, 528, 534. The flag will be cleared in the step 530 and the dose count will be reduced by one in the step 532. It should be noted that the dose count corresponds to the number of pills remaining in the package assembly. If the dose count has reached zero in the step 538, then the whole circuit will be shut down in the step 540. If the count is not zero in the step 538, then a signal will be sent to turn off the Alarm in the step 536. Since the Alarm was never turned on to begin with, this will have no effect.

If step 524 detects that the Pre-Alarm Flag has not been set, the Alarm will be triggered and the Post-Alarm Interval will begin in the step 526. The Alarm will continue until a pill is expelled, as detected in step 528 or the Post-Alarm Interval is up in step 534. Again as before, after a pill is dispensed in the step 528, the Dose count will be reduced by one in the step 532 and if the does count has reached zero as checked in step 538, the whole circuit will be shut down in the step 540. Also as before, if the count is not zero, then a signal will be sent to turn off the Alarm in the step 536. If during the Post Alarm Interval a pill 122 has not been dispensed and the Post-Alarm Interval is completed in step 534, then the Alarm will be turned off.

Alternatively, if desired, the Post-Alarm Interval and the Alarm in the steps 526, 528 and 534 may be repeated a set number times after a predetermined Repeat Delay Interval (This repeat cycle is not depicted on the flow chart). If the pill is dispensed during this time or if the all the repeat alarm cycles have been completed and no pill being expelled, the Alarm would be turned off.

Figure 19A:
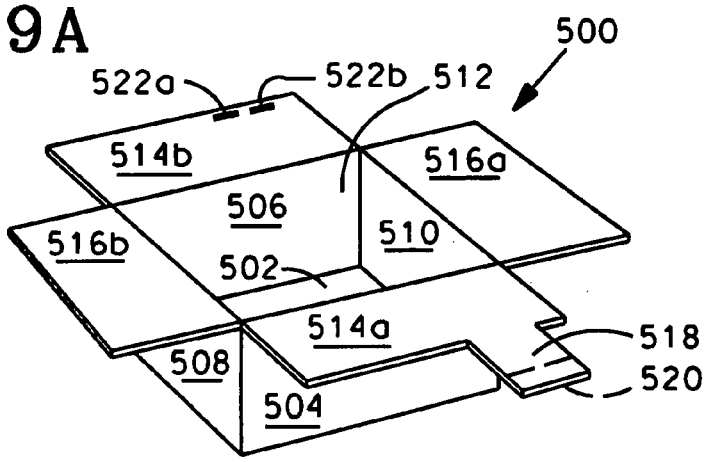
FIGS. 19A-19D is the perspective view of a container having a momentary switch thereon in accordance to another embodiment of the invention.
Figure 19B:
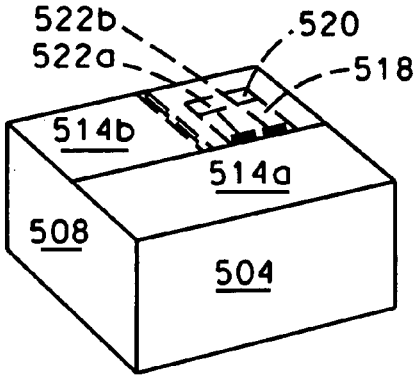
Figure 19C:
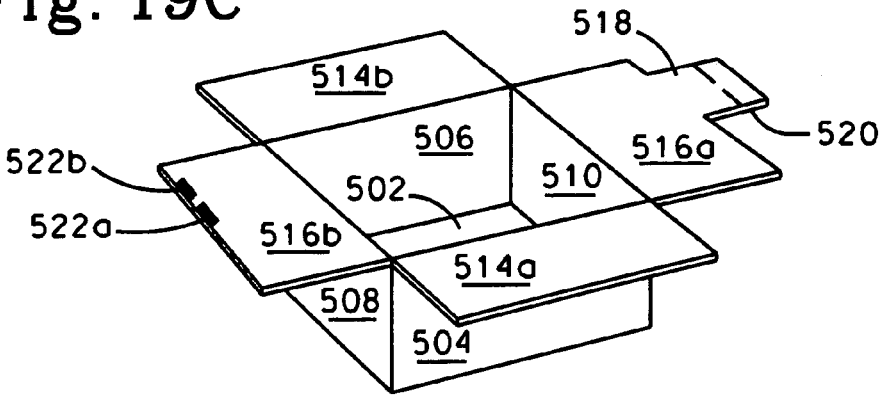
Figure 19D:
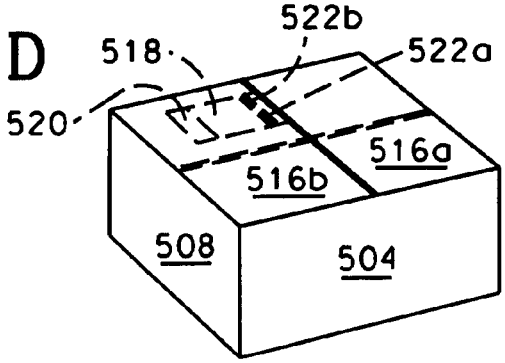

FIGS. 19A-19D illustrates a container 500 having the momentary switch therein in accordance to the present invention. The momentary switch described hereinabove can be used in the container 500 for shipping and/or storing articles (not shown). FIG. 19A shows the container 500 in an opened position. The container 500 comprises a bottom wall 502 having four orthogonal sidewalls 504, 506, 508, 510 extending upwardly from the bottom wall 502 to define an interior space 512, and four flaps 514*a*, 514*b*, 516*a*, 516*b* integrally attached and extended from the respective four orthogonal sidewalls 504, 506, 508, 510. The momentary switched 290 or 490 can be used in the container 500. In the exemplary embodiment of FIG. 19A, the flap 514*a* includes a tab 518 extending outwardly from thereof The tab 518 includes a contacting surface 520 printed thereon. The flap 514*b* includes two contacts surfaces 522*a*, 522*b* spaced apart and printed thereon. When the container 500 is in the closed position as shown in FIG. 19B, the momentary switch 290 or 490 is an opened position and the tab 520 is supported by the flap 516*a* and concealed by the flap 514*b*. The tap 520 is sandwiched between the flap 514*b* and 516*a*. When a user attempts to open the container 500, the tap 520 slides between the flaps 514*b* and 516*a* and would come in contact with the two contact surfaces 522*a*, 5522*b* which put the momentary switch 290 or 490 in a closed position. Alternatively, as shown in FIGS. 19C and 19D, tab 518 is extending outwardly from the flap 516*a* and the two contact surfaces 522*a*, 522*b* are printed on the flap 516*b* opposite from the flap 515*a*.

The package assembly 100 could be equipped to communicate with a physician, pharmacist and/or caregiver to keep them abreast of the compliance of the patient to the prescribed regimen. This could be done via a transmitter device embedded in the package assembly 100 which could send a message via pager, text message, email, phone and the like. This could be done immediately when the patient misses a pill with critical medications, eg. anti-psychotics. The notification could also be done periodically such as once a day. In this case, the circuit unit 260 in the assembly package 100 would need to keep a log of the medication taken and/or missed pills so it could be transmitted later.

For the periodic transmission of the date, the package assembly 100 would not need to have a transmitter in itself that would connect directly with the external communication systems but could be enabled to download its data via a reader that is attached to a computer with a phone and/or internet connection. It also could be connected to an external cell phone on personal data assistance (PDA) too. In this embodiment, the package assembly 100 would be placed on the reader and transmit its information via a capacitive couple or via any other RF transmission methods such as used with the various RFID circuits. The host machine such as, but not limited to, computer, cell phone, PDA and would then make the transmission of the data to the appropriate party.

Since many people are now carrying cell phones PDA's or combination devices, the package assembly 100 or 300 would not need to have any electronics in it at all. The package assembly 100 or 300 can provide a reminder to the patient via phone, cell phone, text message, pager and the like. The web address, phone number could be printed on the package assembly so the patient could contact them to set up the reminder scheme. A product or reminder code could also be printed on the package assembly or include with the pharmacy labels that could be entered to set the particular reminder scheme. The patient may have the ability to choose special variations in the start times and such, within limits of the specifics of the medication.

As a variation of this, an outside service could upload the reminder scheme to a cell phone of PDA's calendar/appointment program so the device does not need to be within range of the cell phone or wireless internet system all the time. The actual reminder data and program would be resident on their device. We could partner with a software and/or cell phone manufacturer for this.

In a further variation, a specific medication reminder application could be developed and be resident or downloaded to the device. It could have a better, more tailored interface with the patient and even have the possibility of customized voice or other auditory reminders. A code on the package assembly could be used to bring up a specific reminder scheme which may or may not be customized by the patient. The code could also include the quantity of the medication initially in the package and then calculate when it would be finished and when the individual should reorder the prescription. It could then remind them or even enable them to place the order itself automatically. This feature could also be employed with an outside service.

RFID tagging of pharmaceuticals looks to be a certainty in the near future. As this becomes the mainstream, it would be possible to modify cell phones and PDA's to be able to read these tags at close proximity. From this, the device could be enabled to know what the medication is and the dosing regimen(s). An application in the device could be brought up automatically upon reading the medication's RFID tag and then prompt the user for any other information that is needed to set up the specific reminder scheme. For some medications, the scheme may be setup automatically. As noted above, the device could also know how much medication is initially in the package and reminder to reorder or place the order itself.

As noted above, the package assembly may alternatively use optical sensing for pill removal. It might be possible to print a high refractive index polymer (probably UV cured) or some multiple layers of optical quality material to create a light pipe(s) on the surface of the paperboard. The circuit board would then have an LED transmitter and an optical receiver such as are used in fiber optics communications. The traces could be printed across a pill door in the similar manner as used with a "break-the-trace" type of circuitry. In this case when a pill is pulled out, the trace would be broken and the light signal would be interrupted between the light source and the receiver.

If one can print optical traces as mentioned above, then there may be other possible circuit configurations too, such as sensing exposure to light when the pill is expelled or using the plastic in the blister as one of the optical conductors.

One or more advantages of the present invention are that the momentary switch includes a more reliable sensing feature than those known in the art. For example, the momentary switch is normally open and the momentary switch is closed when the pill is dispensing, therefore, if there is some intermittent continuity in the circuitry, such intermittent continuity in the circuitry has no material adverse effect.

Another advantage of the present invention is that the momentary switch is essentially foolproof with respect to "false" indications of pill removal since the momentary switching of the open circuit can occur only upon the dispensing of the pill from the blister pack.

A further advantage of the present invention is that the circuitry of the momentary switch is similar to that of known keypad type circuitry since the momentary switch is a normally open momentary switch.

Still another advantage of the present invention is that conductive pathways within the circuitry unit can be printed with carbon based inks. Therefore, the present invention does not require expensive silver inks for conductive pathways as it is customary used in conventional printed electronics.

Yet another advantage of the present invention is that the momentary switch may be used in other packaging such as corrugated containers. The momentary switch may be inserted into an accompanying sleeve for protection during handling, storage, shipment and even end user activities. In addition, the present invention may include a child proof feature of the type known in the art in which the child proof feature is associated with the structure of the package.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A switch for use with an article formed from paperboard, the article having a first panel and a second panel, the first panel and the second panel each having a sliding surface facing one another wherein the first and the second panels are in sliding relation to one another between a first position and a second position, the switch comprising:

a conductive pathway disposed on the sliding surface of the first panel;

a first contact surface disposed on the sliding surface of the second panel and a second contact surface disposed on the sliding surface of the second panel, the second contact surface being in spaced relation to the first contact surface so as to prevent electrical communication between the first and second contact surfaces and wherein the conductive pathway of the first panel is in spaced relation to at least one of the first and second contact surfaces of the second panel when the first and second panels are in the first position, and wherein the conductive pathway bridges the first and second contact surfaces when the first and second panels are in the second position, thereby permitting electrical communication between said first and second contact surfaces.

2. The switch of claim 1 wherein the first panel is defined by at least one swing door formed by a non-continuous cut line in a contact panel of the article.

3. The switch of claim 2 wherein the contact panel includes a plurality of swing doors formed therein and wherein each of the swing doors is interrupted by at least one nick adapted to hold the swing door to the contact panel.

4. The switch of claim 2 wherein the swing door has a generally oval body portion adapted to pivot with respect to the contact panel.

5. The switch of claim 2 wherein the swing door includes a tab projecting therefrom.

6. The switch of claim 5 wherein the conductive pathway is provided at least partways across a contacting surface of the tab.

7. The switch of claim 1 wherein the second panel is defined by at least one punch out formed in a circuit panel of the article.

8. The switch of claim 7 wherein the circuit panel includes a plurality of punch outs formed therein.

9. The switch of claim 7 wherein the first and second contact surfaces are provided at least partways across the punch out.

10. The switch of claim 7 wherein a microprocessor is disposed on said circuit panel and wherein the microprocessor is in closed electrical communication with the first and second contact surfaces when the conductive pathway bridges the first and second contact surface.

11. The switch of claim 2 wherein the swing door has a generally frusto-oval portion adapted to pivot with respect to the contact panel.

12. The switch of claim 2 wherein a portion of the swing door is defined by the contacting surface having the conductive pathway printed thereon.

13. The switch of claim 7 wherein the second panel is defined by a first swing door and a second swing door that are formed by non-continuous score lines in the circuit panel.

14. The switch of claim 13 wherein the first swing door and the second swing door are formed on opposed sides of the punch out.

15. The switch of claim 13 wherein the respective first and second swing doors is interrupted by a of nicks so as to hold the first and the second swing doors to the circuit panel.

16. The switch of claim 13 wherein the respective first and second swing doors pivots with respect to the circuit panel.

17. The switch of claim 13 wherein the respective first and second swing doors are generally rectangular in shape and wherein the first swing door is substantially larger in size than the second swing door.

18. The switch of claim 13 wherein the second swing door is formed to protect the contacting surface when the switch is in the first position.

19. The switch of claim 13 wherein the first swing door includes the first and second contact surfaces printed on a periphery of the first swing door.

20. The switch of claim 13 wherein the circuit panel includes a two dimensional matrix of the first and second swing doors formed thereon.

21. The switch of claim 13 wherein the plurality of swing doors on the contact panel corresponds to the two dimensional matrix of the punch out on the circuit panel.

22. The switch of claim 1 wherein the plurality of swing doors on the contact panel corresponds to the 2D matrix of the first and second swing doors on the circuit panel.

23. The switch of claim 3 wherein each of the swing doors on the contact panel aligned with each of the first and second swing doors on the circuit panel such that the second swing door covers the conductive pathway when the switch is in the first position.

24. The switch of claim 2 wherein the switch is in the second position when the swing door conducting pathway is sliding over the first and second contact surfaces of the circuit panel.

25. The switch of claim 2 wherein combined widths of the swing door conducting pathway and first and second contact surfaces causes the switch to remain in the second position.

26. A package having a switch for use with an article formed from paperboard comprising:

at least one contact panel having a conductive pathway, the contact panel being defined by a plurality of swing doors formed by a non-continuous score lines wherein each of the plurality of swing doors pivots in and out of plane of the at least one contact panel;

at least one circuit panel having a first conductive contact surface and a second conductive contact surface spaced apart from one another so as to prevent electrical communication between the first conductive contact surface and the second conductive contact surface, the at least one circuit panel and the at least one contact and being integrally attached to one another;

at least one blister cavity capable of having an article therein being positioned relative to the at least one contact panel such that dispensing the article from the at least one blister cavity causes the conductive pathway to bridge the first and second conductive surfaces and to thereby permit electrical communication between the at least one contact panel and the at least one circuit panel.

27. The package of claim 26 wherein each of the swing doors configured to have a contacting surface having the conductive pathway printed thereon.

28. The package of claim 26 wherein the circuit panel is defined by a two dimensional matrix of punch outs formed therein.

29. The package of claim 28 wherein each of the punch out is defined by a first swing door and a second swing door that are formed by non-continuous score lines.

30. The package of claim 29 wherein the first swing door and the second swing door are formed on opposed sides of the punch out.

31. The package of claim 26 wherein the article in the blister cavity is a pill.

32. The package of claim 26 wherein the at least one blister cavity includes a plurality of blister cavities having a pill disposed therein and wherein the blister cavity is sealed with a foil layer.

33. The package of claim 26 further comprising an exterior panel having a plurality of tear away doors formed by non-continuous score lines and wherein the exterior panel is integrally attached to the circuit panel.

34. The package of claim 26 further comprising a blister panel having a plurality of punch out formed therein and wherein the blister panel is integrally attached to the circuit panel.

35. The package of claim 32 wherein the plurality of the blister cavities corresponds to the plurality of punch out in the blister panel.

36. The package of claim 26 wherein the contact panel and circuit panel cooperate with one another to form a switch wherein the switch is an open position when the conductive pathway of the contact panel is in spaced relation to at least one of the conductive contact surfaces and wherein the switch is in a closed position when the conductive pathway bridges between the first and second conductive surfaces and to thereby permit electrical communication between the contact panel and the circuit panel.

37. The package of claim 26 wherein the dispensing of pill causes the swing door to pivot downwardly so that the swing door slides over the contact surfaces to bridge electrical communication.

38. A blank used to form a package comprising:

first, second, and third score lines divide the blank into at least one contact panel, at least one circuit panel, at least one blister panel, and at least exterior panel wherein the contact panel and the circuit panel are formed by the first score line, the blister panel and exterior panel are formed by the second score line and third score line delimit the circuit panel and exterior panel from one another and wherein the contact panel comprising a plurality of swing doors each having a tab projecting therefrom formed therein and wherein each of the swing doors is interrupted by at least one nick adapted to hold the swing door to the contact panel wherein each of the plurality of swing doors configured to pivot with respect to the contact panel, the circuit panel having at least one punch out hole therein, the exterior panel having at least one tear away door therein, and the blister panel having at least one punch out hole configured to receive a blister pack protruded therefrom and wherein the at least one contact panel, the at least one circuit panel, the at least one blister panel, and the at least exterior panel cooperate with one another to construct the package.

* * * * *